US011834248B2

(12) United States Patent
Fu et al.

(10) Patent No.: US 11,834,248 B2
(45) Date of Patent: Dec. 5, 2023

(54) APPARATUSES WITH ELASTIC SHEETS FOR PACKAGING

(71) Applicant: ZHEJIANG DAHUA TECHNOLOGY CO., LTD., Zhejiang (CN)

(72) Inventors: Qiujia Fu, Hangzhou (CN); Ye Yao, Hangzhou (CN); Xiantao Zeng, Hangzhou (CN); Qianli Zhang, Hangzhou (CN); Yikun Liang, Hangzhou (CN)

(73) Assignee: ZHEJIANG DAHUA TECHNOLOGY CO., LTD., Hangzhou (CN)

( * ) Notice: Subject to any disclaimer, the term of this patent is extended or adjusted under 35 U.S.C. 154(b) by 0 days.

(21) Appl. No.: 17/655,171

(22) Filed: Mar. 16, 2022

(65) Prior Publication Data

US 2022/0204242 A1 Jun. 30, 2022

Related U.S. Application Data

(63) Continuation of application No. PCT/CN2020/118535, filed on Sep. 28, 2020.

(30) Foreign Application Priority Data

Sep. 30, 2019 (CN) ..... 201921650763.5
Sep. 30, 2019 (CN) ..... 201921652021.6
Dec. 31, 2019 (CN) ..... 201922501569.7

(51) Int. Cl.
*B65D 81/07* (2006.01)
*B65D 5/04* (2006.01)
*B65D 5/50* (2006.01)

(52) U.S. Cl.
CPC ..... *B65D 81/075* (2013.01); *B65D 5/04* (2013.01); *B65D 5/5088* (2013.01); *B65D 2581/055* (2013.01)

(58) Field of Classification Search
CPC . B31B 50/81; B31B 2100/00; B31B 2100/20; B65D 5/04; B65D 5/50;
(Continued)

(56) References Cited

U.S. PATENT DOCUMENTS 3,692,264 A * 9/1972 Burkhard ..... G04B 43/002 206/583
5,386,911 A 2/1995 Payne
(Continued)

FOREIGN PATENT DOCUMENTS

CN 102923398 B 2/2015
CN 206827107 U 1/2018
(Continued)

OTHER PUBLICATIONS

International Search Report in PCT/CN2020/118535 dated Jan. 4, 2021, 5 pages.
(Continued)

*Primary Examiner* — Bryon P Gehman
(74) *Attorney, Agent, or Firm* — METIS IP LLC

(57) ABSTRACT

The present disclosure provides a packaging apparatus. The packaging structure may include a main body including one or more base plates and one or more elastic sheets. Each of the base plates may have two opposite first side edges, two opposite second side edges, and an opening. Each of the one or more elastic sheets may correspond to one of the one or more base plates. The one or more elastic sheets may be physically connected with the main body, and each of the one or more elastic sheets may cover at least a part of the opening. The main body may further include a first side plate
(Continued)

disposed beside at least one of the two opposite first side edges and a second side plate disposed beside each of the two opposite second side edges.

7 Claims, 20 Drawing Sheets

(58) Field of Classification Search
CPC .... B65D 5/5038; B65D 5/5088; B65D 77/26; B65D 81/07; B65D 81/075; B65D 2581/055
USPC ..... 206/583, 588
See application file for complete search history.

(56) References Cited

U.S. PATENT DOCUMENTS

| | | | | |
|---|---|---|---|---|
| 5,762,200 | A * | 6/1998 | Goudreau | B65D 5/5035 206/583 |
| 6,302,274 | B1 * | 10/2001 | Ridgeway | B65D 5/5038 206/583 |
| 7,086,534 | B2 * | 8/2006 | Roesel | B65D 5/5028 206/583 |
| 8,727,123 | B1 * | 5/2014 | Roberts | B65D 81/075 206/583 |
| 9,150,343 | B2 * | 10/2015 | Roberts | B65D 81/075 |

FOREIGN PATENT DOCUMENTS

| | | | |
|---|---|---|---|
| CN | 108045693 | A | 5/2018 |
| CN | 207482390 | U | 6/2018 |
| CN | 208307444 | U | 1/2019 |
| CN | 208979295 | U | 6/2019 |
| CN | 210618770 | U | 5/2020 |
| CN | 211167783 | U | 8/2020 |
| JP | H07330034 | A | 12/1995 |
| JP | H09290804 | A | 11/1997 |
| JP | H1029625 | A | 2/1998 |
| JP | H1035737 | A | 2/1998 |
| JP | 2000142812 | A | 5/2000 |
| JP | 2004231228 | A | 8/2004 |
| JP | 4364746 | B2 | 11/2009 |
| KR | 20090112104 | A | 10/2009 |
| WO | 0132515 | A1 | 5/2001 |

OTHER PUBLICATIONS

Written Opinion in PCT/CN2020/118535 dated Jan. 4, 2021, 5 pages.
The Extended European Search Report in European Application No. 20870992.3 dated Sep. 16, 2022, 7 pages.

* cited by examiner

APPARATUSES WITH ELASTIC SHEETS FOR PACKAGING

CROSS-REFERENCE TO RELATED APPLICATIONS

This application is a Continuation of International Application No. PCT/CN2020/118535 filed on Sep. 28, 2020, which claims priority to Chinese Patent Application No. 201921650763.5, filed on Sep. 30, 2019, Chinese Patent Application No. 201921652021.6, filed on Sep. 30, 2019, and Chinese Patent Application No. 201922501569.7, filed on Dec. 31, 2019, the contents of each of which are hereby incorporated by reference.

TECHNICAL FIELD

The disclosure generally relates to packaging technology, and more particularly relates to a packaging structure.

BACKGROUND

During transportation, a certain object or product needs to be packaged to immobilize and protect the object, thereby achieving a better transportation effect. When packaging products, products in different shapes or products in irregular shapes need different packaging structures. Therefore, it is necessary to provide a packaging apparatus that may adapt to an object in an irregular shape or objects in different shapes.

SUMMARY

One or more embodiments of the present disclosure provide a packaging apparatus. The packaging apparatus may include a main body including multiple base plates and multiple elastic sheets. Each of the base plates may have two opposite first side edges, two opposite second side edges, and an opening. Each of the multiple elastic sheets may correspond to one of the one or more base plates. The multiple elastic sheets may be physically connected with the main body. Each of the multiple elastic sheets may cover at least a part of the opening. The main body may further include a first side plate disposed beside at least one of the two opposite first side edges and a second side plate disposed beside each of the two opposite second side edges. When using the packaging apparatus to package a subject, the multiple base plates may be attached and the subject may be located between the multiple elastic sheets.

In some embodiments, at least one of the multiple elastic sheets may be disposed on a side of the base plate where the subject is located.

In some embodiments, at least one of the one or more elastic sheets may be physically connected with the base plate.

In some embodiments, the main body may include two base plates.

In some embodiments, the main body may further include a third side plate disposed beside one of the first side edges of each of the two base plates, and a first folding plate disposed between the third side plates.

In some embodiments, the main body may further include one or more second folding plates, one or more third folding plates, and one or more fourth folding plates. The second folding plates may be respectively disposed beside ends of the first side plate along a direction parallel to the first side edge. The third folding plates may be disposed beside the second side plate. The fourth folding plates may be respectively disposed beside ends of the third side plate along a direction parallel to the first side edge. A first folding line may be disposed between the second folding plate and the first side plate, a second folding line may be disposed between the third folding plate and the second side plate, and a third folding line may be disposed between the fourth folding plate and the third side plate.

In some embodiments, a first coupling component may be disposed between the second side plate and the base plate and a first matching component may be disposed on the third folding plate. In a folding state, the first coupling component may match the first matching component.

In some embodiments, the main body may further include a fifth folding plate, a sixth folding plate, and a seventh folding plate. The fifth folding plate, the sixth folding plate, and the seventh folding plate may be disposed beside the first folding plate in a direction parallel to the first side plate. In a folding state, the first folding plate, the fifth folding plate, the sixth folding plate, and the seventh folding plate may be configured to form a hollow cube.

In some embodiments, the main body may further include two fifth side plates disposed on two opposite side edges of the fifth folding plate respectively, two sixth side plates disposed on two opposite side edges of the sixth folding plate respectively, and two seventh side plates disposed on two opposite side edges of the seventh folding plate respectively. The two fifth side plates, the two sixth side plates, and the two seventh side plates may be apart from each other.

In some embodiments, a second coupling component may be disposed between the first side plate and the base plate. A third coupling component may be disposed between the base plate and one of the second side plates. A fourth coupling component may be disposed between the base plate and the other one of the second side plates. A second matching component may be disposed on the fifth side plate. A third matching component may be disposed on the sixth side plate. A fourth matching component may be disposed on the seventh side plate. In the folding state, the second coupling component may match the second matching component, the third coupling component may match the third matching component, and the fourth coupling component may match the fourth matching component.

In some embodiments, the main body may further include one or more second folding plates and one or more third folding plates. The second folding plates may be respectively disposed beside both ends of the first side plate along a direction parallel to the first side edge. The third folding plates may be disposed beside the second side plate. A first folding line may be disposed between the second folding plate and the first side plate. A second folding line may be disposed between the third folding plate and the second side plate.

In some embodiments, the main body may further include one or more second folding plates disposed beside ends of the first side plate along a direction parallel to the first side edge, and one or more third folding plates disposed beside the second side plate. A first folding line may be disposed between the second folding plate and the first side plate, and a second folding line may be disposed between the third folding plate and the second side plate.

In some embodiments, a first coupling component may be disposed between the second side plate and the base plate, and a first matching component may be disposed on the third folding plate. In a folding state, the first coupling component may match the first matching component.

In some embodiments, the main body may include one or more corner plates disposed between the adjacent first side plate and second side plate.

In some embodiments, each of at least one of the one or more corner plates may include a first portion and a second portion. The first portion may be disposed beside the first side plate. The second portion may be disposed beside the second side plate. A folding mark may be disposed between the first portion and the second portion.

In some embodiments, each of at least one of the one or more corner plates may include a cutting line. Both ends of the cut line may be disposed on the folding mark.

In some embodiments, the cutting line may include one or more straight line segments or an arc line.

In some embodiments, the second side plate may be physically connected with the second portion of the corner plate. The second side plate may be attached with the base plate, and the first side plate may be physically connected with the first portion of the corner plate.

One or more embodiments of the present disclosure provide a packaging apparatus. The packaging apparatus may include a first portion including a first base plate, multiple first side plates around the first base plate, and a first elastic sheet covering at least a part of a first opening on the first base plate. The packaging apparatus may also include a second portion including a second base plate, multiple second side plates around the second base plate, and a second elastic sheet covering at least a part of a second opening the second base plate. When using the packaging apparatus to package a subject, the first base plate and the second base plate may be attached with each other, and the subject may be located between the first elastic sheet and the second elastic sheet.

Additional features will be set forth in part in the description which follows, and in part will become apparent to those skilled in the art upon examination of the following and the accompanying drawings or may be learned by production or operation of the examples. The features of the present disclosure may be realized and attained by practice or use of various aspects of the methodologies, instrumentalities, and combinations set forth in the detailed examples discussed below.

BRIEF DESCRIPTION OF THE DRAWINGS

The present disclosure is further described in terms of exemplary embodiments. These exemplary embodiments are described in detail with reference to the drawings. The drawings are not scaled. These embodiments are non-limiting exemplary embodiments, in which like reference numerals represent similar structures throughout the several views of the drawings, and wherein.

Figure 1:
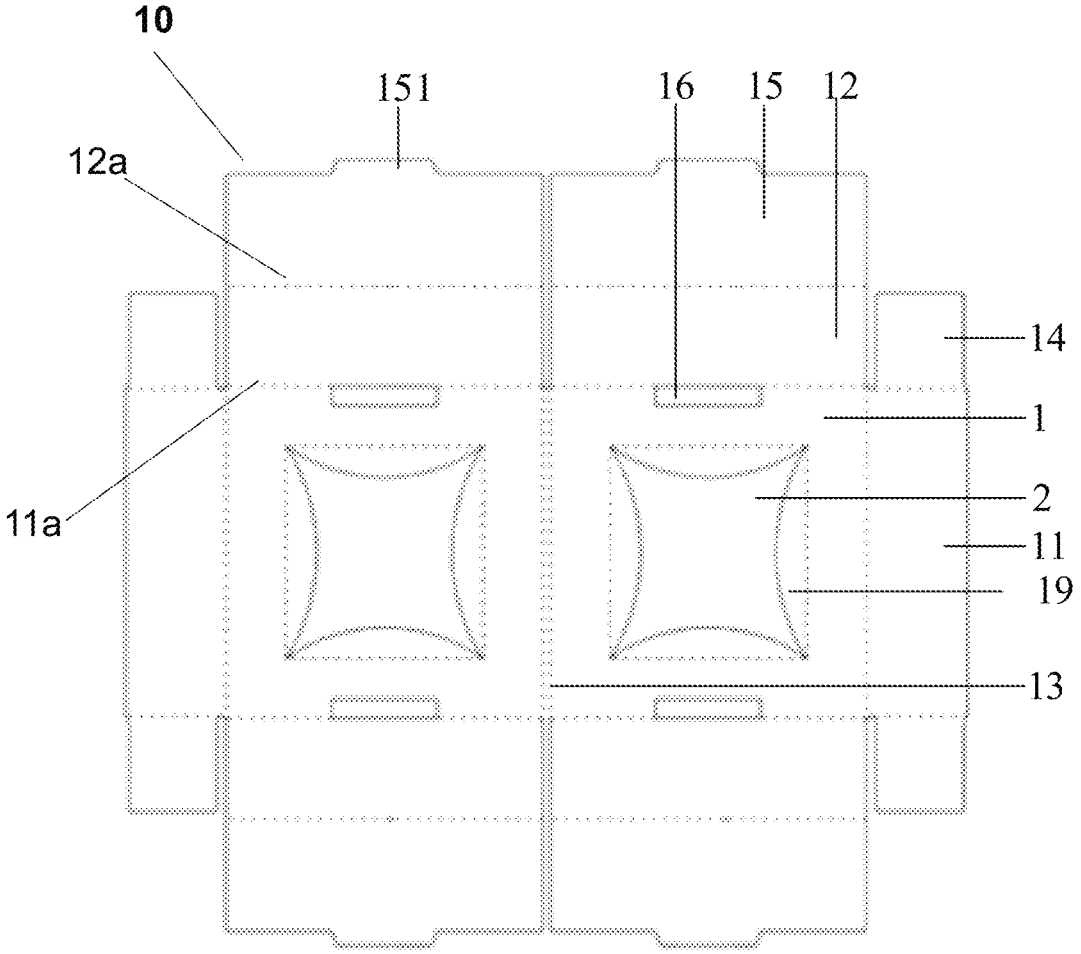
FIG. 1 is a schematic diagram illustrating an exemplary unfolded packaging apparatus according to some embodiments of the present disclosure.

The reference numerals are:

1—base plate, 2—elastic sheet, 3—first folding plate, 4—fifth folding plate, 6—sixth folding plate, 7—seventh folding plate, 8—connecting plate, 9—corner plate, 10—main body, 11—first side plate, 12—second side plate, 13—coupling side plate, 14—second folding plate, 15—third folding plate, 16—first coupling component, 17—third side plate, 18—fourth folding plate, 19—opening, 151—first matching component, 11*a*—first folding line, 12*a*—second folding line, 17*a*—third folding line, 41—fifth side plate, 411—second matching component, 412—third coupling component, 61—sixth side plate, 611—third matching component, 612—fourth coupling component, 71—seventh side plate, 711—fourth matching component, 712—second coupling component, 91—first portion, 92—second portion, and 93—protrusion portion.

DETAILED DESCRIPTION

The following description is presented to enable any person skilled in the art to make and use the present disclosure and is provided in the context of a particular application and its requirements. Various modifications to the disclosed embodiments will be readily apparent to those skilled in the art, and the general principles defined herein may be applied to other embodiments and applications without departing from the spirit and scope of the present disclosure. Thus, the present disclosure is not limited to the embodiments shown but is to be accorded the widest scope consistent with the claims.

The terminology used herein is for the purpose of describing particular example embodiments only and is not intended to be limiting. As used herein, the singular forms "a," "an," and "the" may be intended to include the plural forms as well, unless the context clearly indicates otherwise. It will be further understood that the terms "comprise," "comprises," and/or "comprising," "include," "includes," and/or "including" when used in this disclosure, specify the presence of stated features, integers, steps, operations, elements, and/or components, but do not preclude the presence or addition of one or more other features, integers, steps, operations, elements, components, and/or groups thereof.

It should be understood that the "first," "second," "third," "fourth," "fifth," "sixth," "seventh," and similar words used in the disclosure are not intended to indicate any order, quantity, or importance, but only used to distinguish different components. Unless otherwise indicated, such words as "front," "back," "lower," and/or "upper" are only for convenience of description, and are not limited to one position or one spatial orientation.

In some embodiments, the numbers expressing quantities, properties, and so forth, used to describe and claim certain embodiments of the application are to be understood as being modified in some instances by the term "about," "approximate," or "substantially." For example, "about," "approximate" or "substantially" may indicate ±20% variation of the value it describes, unless otherwise stated. Accordingly, in some embodiments, the numerical parameters set forth in the written description and attached claims are approximations that may vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the application are approximations, the numerical values set forth in the specific examples are reported as precisely as practicable.

In some embodiments, a packaging apparatus including a combination of a paper card and an elastic sheet may generally be used to package an object. For example, the object may be placed on the paper card. Then, one end of the elastic sheet may be pasted to an end portion of the paper card, and the other end of the elastic sheet may be pasted to another end of the paper card. The elastic sheet may be located above or cover the object. And the elastic sheet may be stretched by folding the paper card. The stretched elastic sheet may elastically press and/or immobilize the object on the paper card, thereby completing the product packaging. However, some objects in irregular shapes cannot be placed flat on the paper card, which increases the production cost of packaging apparatuses, increases the difficulty in the operation of the production line of packaging apparatuses, and leads an unsightly appearance of the packaging apparatuses. Specially for such objects as marine products, products with a high moisture-proof requirement, precision instrument products, etc., there may be a potential safety hazard of water vapor intrusion. Therefore, one or more embodiments of this disclosure provide a packaging apparatus that may adapt to an object in an irregular shape or adapt to objects in different shapes and have good moisture resistance.

One or more embodiments of this disclosure provide a packaging structure. The packaging structure may include one or more main bodies and one or more elastic sheets. Each of the one or more main bodies may be folded to provide protection and support for an object to be packaged. Each of the elastic sheets may be stretched along one or more directions to immobilize the object in the packaging apparatus. The elastic sheets may be made of an elastic material, such as an elastic plastic, an elastic resin, an elastic fiber, etc.

In some embodiments, the packaging structure may include one single main body that includes multiple base plates (e.g. two). The one single main body may include multiple base plates. Each of the one or more elastic sheets may correspond to one of the base plates. The count or number of the one or more elastic sheets may be equal to the count or number of the one or more base plates. For example, if the main body includes two base plates, the packaging structure may include two elastic sheets. One of the elastic sheets may be matched with one of the base plates, and the other elastic sheet may be matched with the other base plate 1.

In some embodiments, the packaging structure may include multiple main bodies each of which includes a single base plate. Each of the one or more elastic sheets may correspond to one of the main bodies. When the packaging structure is in an unfolded state, the two main bodies may be separated from each other. Each of the two main bodies may be folded independently. When the packaging structure is in a folded state, the two main bodies may be physically connected.

Each of the one or more base plates may have two opposite first side edges and two opposite second side edges. As used herein, two opposite side edges refer to that the two side edges are not intersected. For example, if a base plate is a rectangle, the two opposite first side edges may be parallel with each other; and the two opposite second side edges may be parallel with each other.

For each base plate, at least one of the two first side edges may be configured with a first side plate, and each of the two second side edges may be configured with a second side plate.

In some embodiments, each base plate may be provided with an opening, and each elastic sheet may conform to the opening. In some embodiments, each elastic sheet may be fixed on the main body (e.g., the base plate) and cover at least a part of the corresponding opening on the base plate. For example, the elastic sheet 2 may be physically connected on the base plate 1 to cover the whole opening. As another example, the elastic sheet 2 may be merely physically connected on one pair of opposite edges of the opening in a shape of a rectangle, so as cover a middle portion of the opening. In some embodiments, in order to cover the at least a part of the corresponding opening, the elastic sheet may be fixed on the base plate or the main body around the periphery of the base plate. In some embodiments, the elastic sheet may be fixed on the backside of the corresponding base plate or the front side of the corresponding base plate. As used herein, the front side of a base plate refers to a surface of the base plate where an object to be packaged is located at. The backside of the base plate may be opposite to the front side of the base plate. In a folding state, the first side plates and/or the second side plates around the base plate may be folded toward the front side of the base plate.

In some embodiments, the object may be packaged based on two openings on the two base plates and two corresponding elastic sheets covering at least a part of each of the openings. In some embodiments, if the main body includes one single base plate, the object may be packaged using two main bodies and two corresponding elastic sheets. In some embodiments, if the main body includes two base plates, the object may be packaged by folding the main body and using the corresponding two elastic sheets. A packaging apparatus including two main bodies each of which includes one single base plate or a packaging apparatus including the main body that includes two base plates may be described below, respectively.

For example, FIG. 1-9 are schematic diagrams illustrating exemplary packaging apparatuses each of which including a main body according to some embodiments of the present disclosure. FIGS. 1-3A and 6A are schematic diagrams illustrating exemplary unfolded packaging apparatuses according to some embodiments of the present disclosure. As shown in FIGS. 1-3A, and 6A, the packaging apparatus as shown in each of FIGS. 1-3A and 6A may include a main body 10 and an elastic sheet 2. The main body 10 may include two base plates 1. Each of the two base plates 1 may have a quadrilateral shape. Each of the base plates 1 may have two opposite first side edges and two opposite second side edges.

In some embodiments, the two base plates 1 may be an integrated structure. One or more folding lines 13 may be set on the integrated structure. The one or more folding lines 13 may form the first side edges of the two base plates 1 that are also referred to as coupling side edges 13. The integrated structure may be folded along the one or more folding lines 13 to form the two base plates 1. In some embodiments, the two base plates 1 may share a side edge as shown in FIG. 3. One single folding line 13 may be disposed between the two base plates. As another example, as shown in FIG. 1, each base plate 1 may correspond to a coupling side edge 13, and the two base plates 1 may be directly or indirectly connected through the coupling side edge 13. The coupling side edge 13 may be regarded as one of the two first side edges. The two base plates 1 may be directly connected through their respective coupling side edges 13 as shown in FIG. 1.

Figure 2:
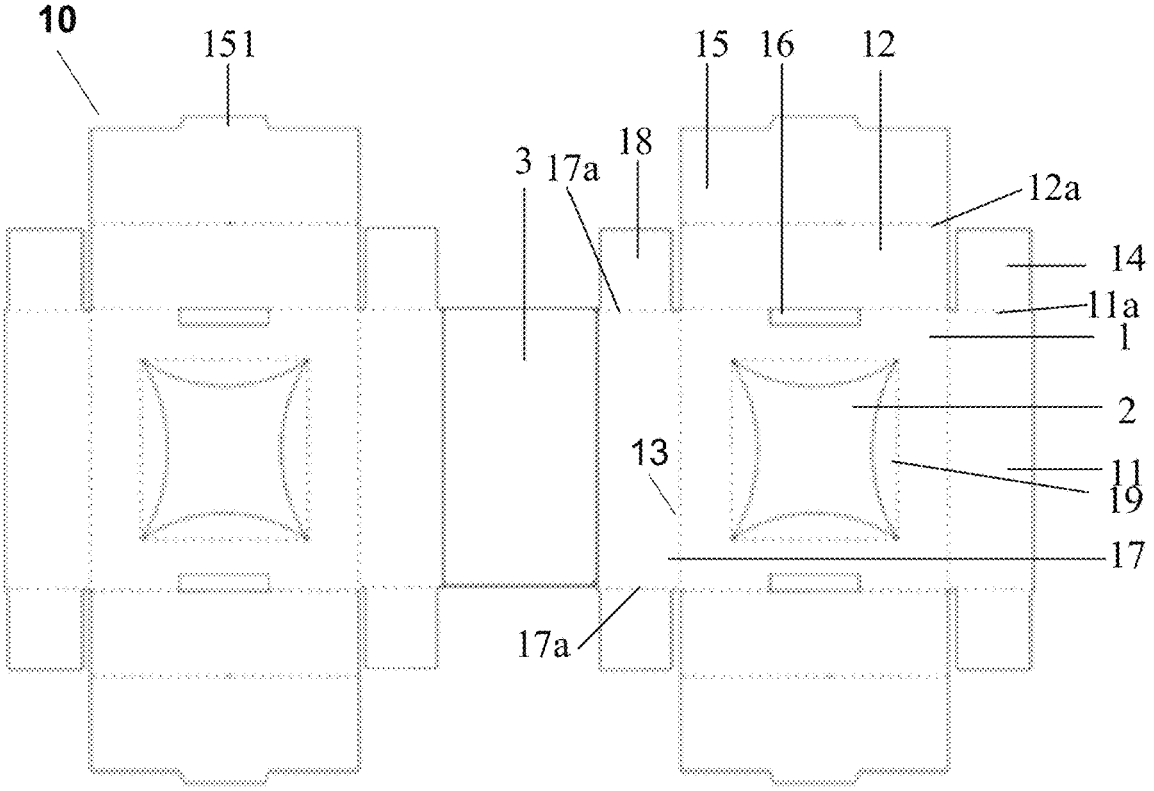
FIG. 2 is a schematic diagram illustrating another exemplary unfolded packaging apparatus according to some embodiments of the present disclosure.

In some embodiments, as shown in FIG. 2, a folding plate 3 (i.e., the first folding plate) may be disposed between the two base plates 1. The two base plates may be connected via the folding plate 3. In some embodiments, as shown in FIG. 2, the main body 10 may include a third side plate 17 disposed beside one of the first side edges of each of the two base plates 1, and a folding plate 3 may be disposed between the third side plates of the two base plate 1. In some embodiments, a sum of the widths of the two third side plates 17 may be substantially equal to the width of the first folding plate 3. As used herein, the width may refer to a size of the third side plate 17 or the first folding plate 3 along a direction perpendicular to the first side edge. The widths of the two third side plates 17 may be the same or different. It should be noted that the descriptions regarding the widths of the two third side plates 17 are merely provided for illustration, and not intend to be limiting, as long as the widths of the two third side plates 17 may be the same or different.

In some embodiments, if the two base plates 1 are adjacent with each other as shown in FIG. 1 and FIG. 3, one single of the first side edges of each of the two base plates 1 may be configured with a first side plate 11. Each of the two second side edges may be configured with a second side plate 12. Both the first side plate 11 and the second side plate 12 may be folded toward the front side of the base plate 1 until it is substantially perpendicular to the base plate 1, and the folded first side plate 11 and the second side plate 12 may form a sidewall of the packaging apparatus with three side plates connected in sequence. As used herein, the two adjacent base plates 1 may refer to that there is no other structure disposed between the two base plates.

In some embodiments, if the folding plate 3 is disposed between the two base plates 1 as shown in FIG. 2, one of the first side edges of each of the two base plates 1 may be configured with the first side plate 11 and the other one of the first side edges of each of the two base plates 1 may be configured with the third side plate 17. Each of the two second side edges may be configured with a second side plate 12. Both the first side plate 11, the third side plate 17, and the second side plate 12 may be folded toward the front side of the base plate 1, and the folded first side plate 11, the folded third side plate 17, and the folded second side plate 12 may form the sidewall with four side plates connected in sequence.

In some embodiments, as shown in FIGS. 1-3A, the center region of the base plate 1 may have an opening denoted by a dotted box. The shape of an opening may be a rectangle, a circle, an oval, a triangle, etc.

In some embodiments, the periphery (e.g., vertex parts or edge parts) of the elastic sheet 2 may be physically connected on the base plate 1 along the periphery of the opening to cover at least a part of the opening. When the two base plates 1 are folded in half, the backsides of the two base plates 1 may be attached with each other. The positions of the openings of the two base plates 1 may roughly correspond to each other, thereby forming a protection structure. As used herein, the positions of the openings of the two base plates 1 may correspond to each other may refer to that when the two base plates 1 are folded in half, the two openings of the two base plates 1 may be substantially be overlapped together.

In some embodiments, the elastic sheet 2 may be physically connected with the main body 10. For example, the elastic sheet 2 may be physically connected with the first side plate 11 and/or the second side plate 12. As another example, the elastic sheet 2 may be physically connected with the base plate 1. The elastic sheets 2 may be physically connected with the front side of the base plate 1 or the backside of the base plate 1. Preferably, the elastic sheet 2 may be physically connected with or fixed to the backside of the base plate 1. When the object is placed between the two elastic sheets 2, the object may generate a certain pressure on the two elastic sheets 2. Fixing the elastic sheet 2 on the backside of the base plate 1 may be more conducive to fixing the elastic sheet 2 on the base plate 1.

In some embodiments, the elastic sheet 2 may be pasted on the base plate 1 by an adhesive, or the elastic sheet 2 may be physically connected with the base plate 1 by a fixing member. The adhesive may include a double-sided tape. The fixing member may include a screw, a clip, a fixing post, etc.

Figure 3A:
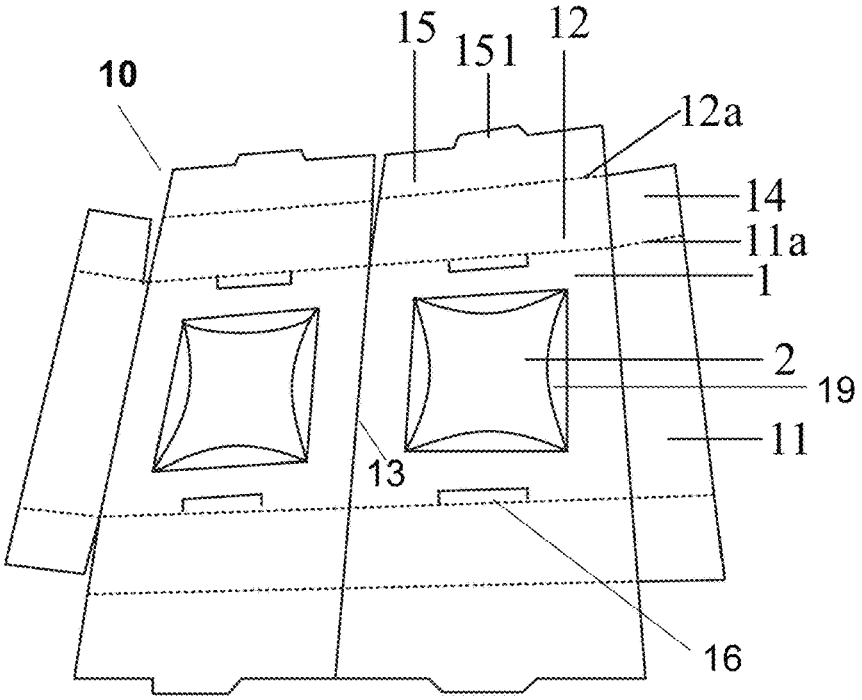
FIG. 3A to FIG. 3D are schematic diagrams illustrating an exemplary process for using a packaging apparatus as shown in FIG. 1 according to some embodiments of the present disclosure.

As shown in FIGS. 1 and 3A, the main body 10 may include two base plates 1 that are adjacent to each other. The two base plates 1 may be directly connected through the two coupling side edges 13. As shown in FIG. 2, the main body 10 may include two base plates 1 that are connected with the first folding plate 3, and two third side plates 17. It should be noted that the two connections methods are merely provided for illustration, and not intend to limit the scope of the present disclosure.

In some embodiments, the main body 10 may include one or more second folding plates 14 and/or one or more third folding plates 15, for example, as shown in FIGS. 1, 2, and 3A. In each of the base plates 1, the second folding plates 14 may be respectively disposed beside the first side plate 11 along a direction parallel to the first side edge. In some embodiments, the second folding plates 14 and the first side plate 11 may be formed by one single plate (e.g., a paper card or a sheet). For example, a first folding line 11*a* may be disposed between the second folding plate 14 and the first side plate 11 along a direction perpendicular to the first side edge. The second folding plates 14 and the first side plate 11 may be formed by folding the one single plate along the first folding line 11*a*. The third folding plates 15 may be disposed beside the second side plate 12. In some embodiments, the third folding plates 15 and the second side plate 12 may be formed by one single plate (e.g., a paper card or a sheet). For example, a second folding line 12*a* may be disposed between the third folding plate 15 and the second side plate 12 parallel to the second side edge. The third folding plate 15 and the second side plate 12 may be folded by folding the one single plate along the second folding line 12*a*.

In some embodiments, the main body 10 may include one or more fourth folding plates 18. As shown in FIG. 2, the fourth folding plates 18 may be respectively disposed on ends of the third side plate 17 along a direction parallel to the first side edge. In some embodiments, the fourth folding plates 18 and the third side plate 17 may be formed by one single plate (e.g., a paper card or a sheet). For example, a third folding line 17*a* may be disposed between the fourth folding plate 18 and the third side plate 17. The fourth folding plate 18 and the third side plate 17 may be folded by folding the one single plate along the third folding line 17*a*.

In some embodiments, the packaging apparatus may further include a first coupling component 16 and a first matching component 151. The first coupling component 16 and the first matching component 151 may be matched to connect with each other. The first coupling component 16 may be disposed between the second side plate 12 and the base plate 1 as shown in FIGS. 1 and 2. The first matching component 151 may be disposed beside the third folding plate 12 as shown in FIGS. 1 and 2. When the second side plate 12 is folded to be substantially perpendicular to the base plate 1 and the third folding plate 15 is folded to be attached to the second side plate 12, the first matching component 151 may match the first coupling component 16 to fix a position of the second side plate 12 and/or the third folding plate 15 relative to the base plate 1, which has a simple structure and is convenient and feasible.

In some embodiments, the first matching component 151 may be a hole, and the first coupling component 16 may be an extending part matching the hole. In some embodiments, the first matching component 151 may match the first coupling component 16 by bonding. For example, the first matching component 151 and the first coupling component 16 may be Velcro or double-sided tape for bonding.

Figure 3B:
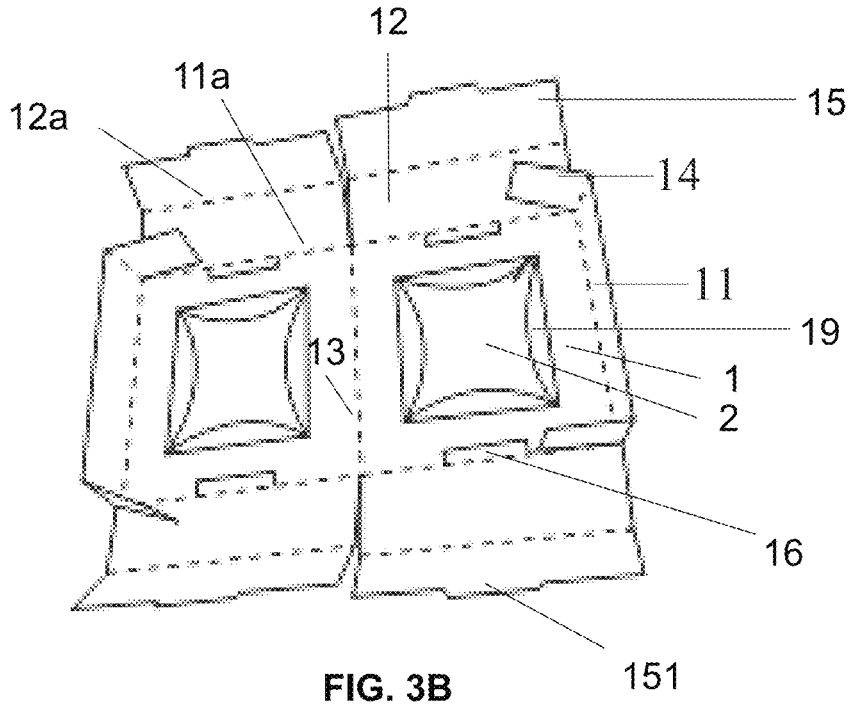
Figure 3C:
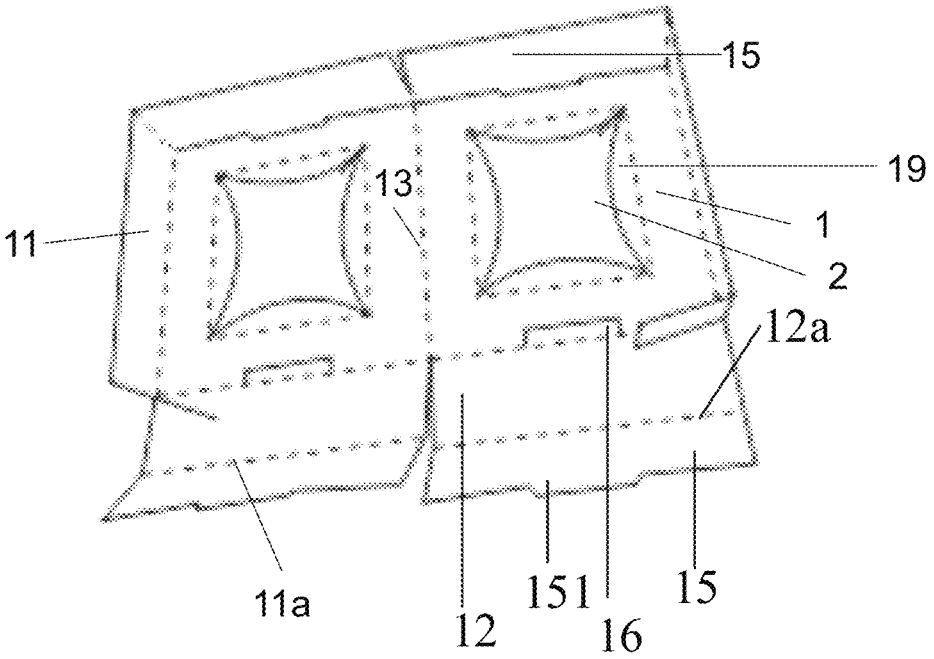
Figure 3D:
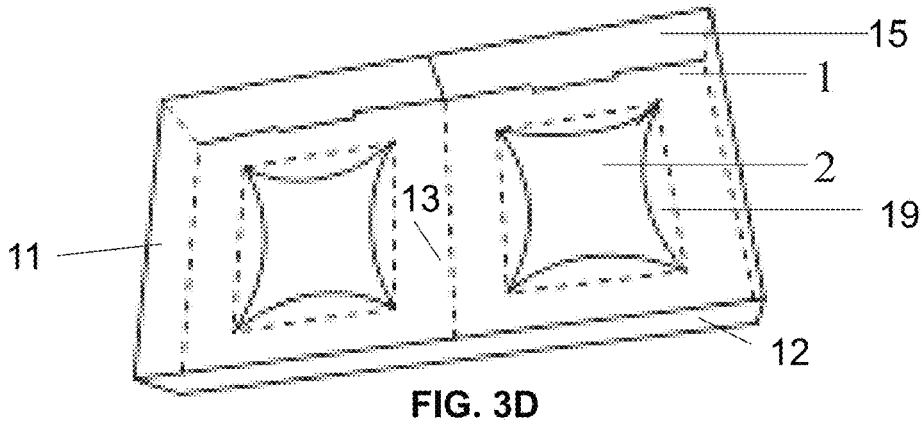

FIG. 3A to FIG. 3D are schematic diagrams illustrating an exemplary process for using a packaging apparatus as shown in FIG. 1 according to some embodiments of the present disclosure. The packaging apparatus as shown in FIG. 3A may be as similar to the same as the packaging apparatus described in FIG. 1. During folding the main body 10, firstly, as shown in FIG. 3A, the first side plate 11 of each of the two base plates 1 may be folded along the corresponding side edge toward the front side of the base plate 1 (for example, until substantially perpendicular to the base plate 1). As shown in FIG. 3B, each of the second folding plates 14 of each of the two base plates 1 disposed beside two ends of the first side plate 11 may be then folded toward the base plate 1 (for example, until substantially perpendicular to the first side plate 11). As shown in FIG. 3C, each of the second side plates 12 of each of the two base plates 1 may be folded along the second side edge toward the front side of the base plate 1 (for example, until substantially perpendicular to the base plate 1). Then, as shown in FIG. 3D, each of the third folding plates 15 may be folded toward the front side of the base plate 1 to attach the second side plate 12, so that each of the second folding plates 14 may be disposed between the second side plate 12 and the third folding plate 15, thereby limiting the movement of the first side plate 11. The third folding plate 15, the second folding plate 14, and the second side plate 12 may form a three-layer structure.

In some embodiments, during the folding process, each of the second side plates 12 of each of the two base plates 1 may be first folded along the second side edges toward the front side of the base plate 1 (for example, until substantially perpendicular to the base plate 1). Then each of the third folding plates 15 of each of the two base plates 1 may be folded toward the front side of the base plate 1 to attach the second side plates 12, and each of the second folding plates 14 disposed beside two ends of the first side plate 11 may be folded toward the front side of the base plate 1 (for example, until substantially perpendicular to the first side plate 11) and embedded between the second side plate 12 and the third folding plate 15. The first side plate 11 of each of the two base plates 1 may be folded along the corresponding first side edge toward the front side of the base plate 1 (for example, until substantially perpendicular to the base plate 1), thereby limiting the movement of the first side plate 11.

Figure 4A:
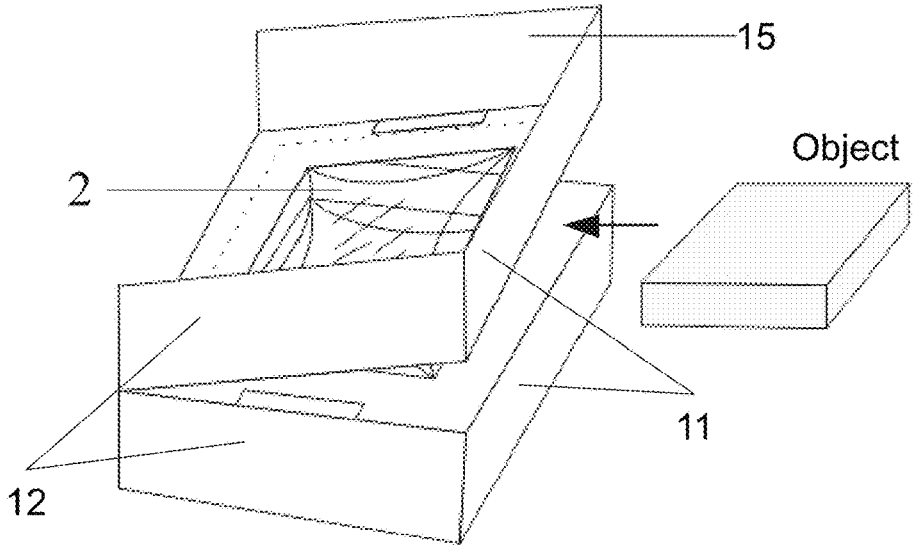
FIG. 4A to FIG. 4B are schematic diagrams illustrating an exemplary process for using a packaging apparatus as shown in FIG. 3D according to some embodiments of the present disclosure.
Figure 4B:
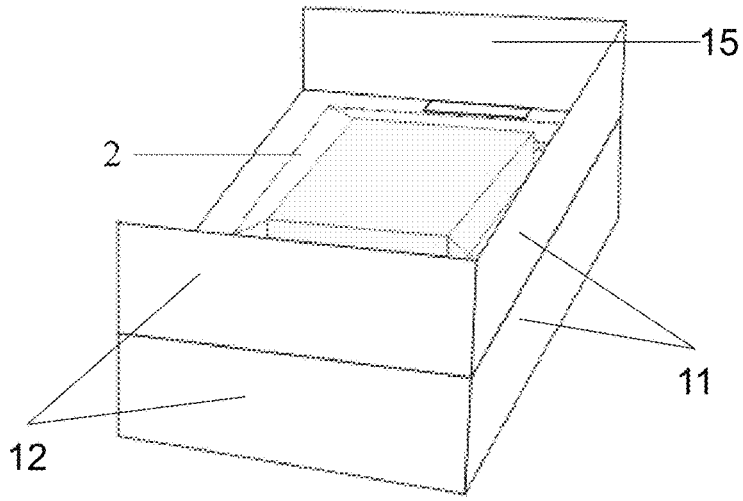

It should be noted that the abovementioned "attach" may include but not be limited to a state indicating that the third folding plate 15 and the second side plate 12 completely contact each other or partially contact each other, a state indicating that the third folding plate 15 and the second side plate 12 are close, etc. After the main body 10 (e.g., the first side plate 11, the second side plates 12, the second folding plates 14, and the third folding plates 15 associated with the two base plates 1) is folded as shown in FIG. 3A-3D, the two base plates 1 may be folded along their respective coupling side edges 13 toward the backside of the base plate 1. A space capable of accommodating an object may be formed between the elastic sheets 2. In the application of the packaging apparatus, an object may be placed between the two elastic sheets 2 as shown in FIG. 4A. Then, the backsides of the two base plates 1 may be attached or connected to package the object as shown in FIG. 4B.

In some embodiments, the backsides of the two base plates 1 may be attached or connected with each other using a physical connection mode. For example, the backsides of the two base plates 1 may be connected with each other using an adhesive provided on the backsides of the base plates 1. As another example, the backsides of the two base plates 1 may be connected with or attached by placing the package structure into a packaging case or carton in a specific shape after the two base plates are attached. The packaging case may keep the backsides of the two base plates being attached. As still another example, the backsides of the two base plates 1 may be attached by bundling the base plates 1 from their periphery using a packaging string.

Figure 5A:
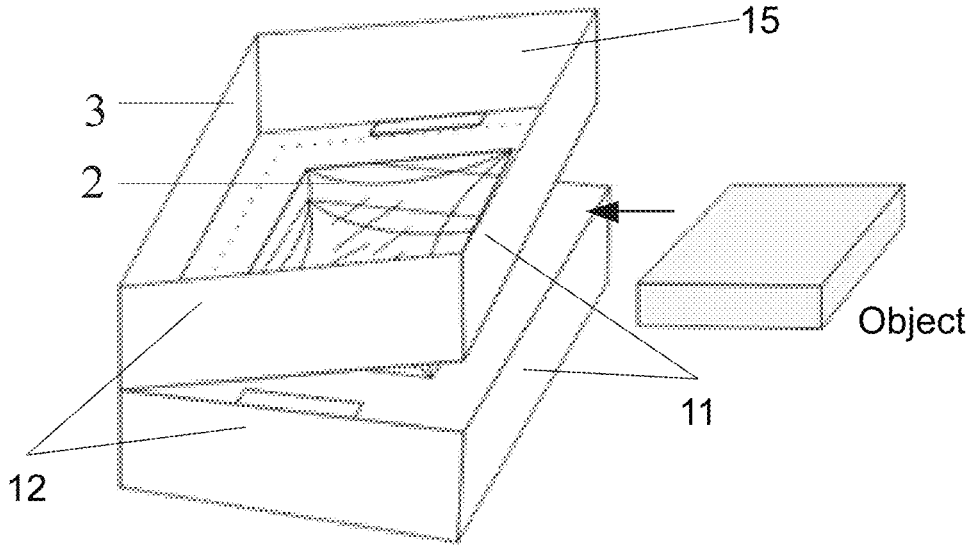
FIG. 5A to FIG. 5B are schematic diagrams illustrating an exemplary process for using a packaging apparatus as shown in FIG. 2 according to some embodiments of the present disclosure.
Figure 5B:
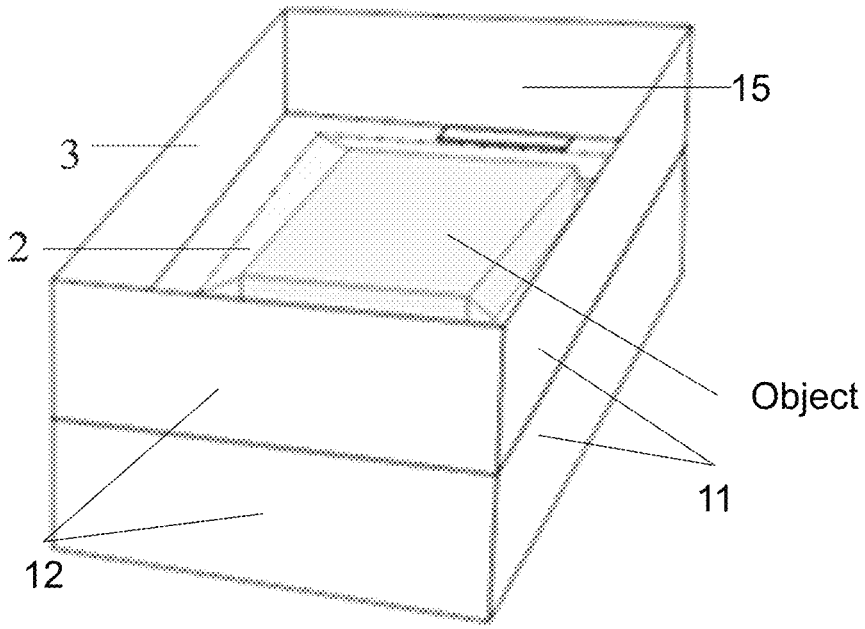

FIGS. 5A—FIG. 5B are schematic diagrams illustrating an exemplary process for using a packaging apparatus as shown in FIG. 2 according to some embodiments of the present disclosure. In the application of the packaging structure, an object may be placed between the two elastic sheets 2 as shown in FIG. 5A. Then, the backsides of the two base plates 1 may be attached to package the object as shown in FIG. 5B.

The main body 10 as shown in FIG. 2 may be folded to generate a box body for packaging the object. The first side plate 11 and the third side plate 17 of each of the two base plates 1 may be folded toward the front side of the corresponding base plate 1 (for example, until substantially perpendicular to the base plate 1). Each of the second folding plates 14 and each of the fourth folding plates 18 may be folded toward the base plate 1 (for example, until perpendicular to the first side plate 11). Each of the second side plates 12 of each of the two base plates 1 may be may be folded toward the front side of the corresponding base plate 1 (for example, until substantially perpendicular to the base plate 1). Then, each of the third folding plates 15 of each of the two base plates 1 may be may be folded to attach the corresponding second side plate 12. In this way, each of the second folding plates 14 and each of the fourth folding plates 18 may be stuck between the second side plate 12 and the third folding plate 15, thereby immobilizing the first side plate 11 and the third side plate 17. The third side plate 17, the first side plate 11, and the second side plates 12 around each base plate 1 may form a sidewall structure of the folded packaging apparatus. The two third side plates 17 may be connected with the third folding plate 15 after being folded. The main body 10 may be further folded such that the backsides of the base plates 1 are attached, and the two third side plates 17 are attached with the first folding plate 3. For example, the two third side plates 17 may be further folded to attach the first folding plate 3. The elastic sheets 2 on the two base plates 1 may form a packaging space capable of accommodating products.

Compared to the abovementioned folding process of the main body 10 shown in FIG. 1, a folding process of the main body 10 shown in FIG. 2 may further include folding the two third side plates 17 to be perpendicular to the base plate 1 and perpendicular to the first folding plate 3, and folding the two third side plates 17 to be attached to the first folding plate 3 so that the backsides of the two base plates 1 are attached to each other. Compared with the packaging apparatus shown in FIG. 1, the packaging apparatus shown in FIG. 2 may have an integral sidewall formed by the first folding plate 3 after the two base plates 1 are folded in half, which may ensure the structural stability of the packaging apparatus during transportation.

Figure 6A:
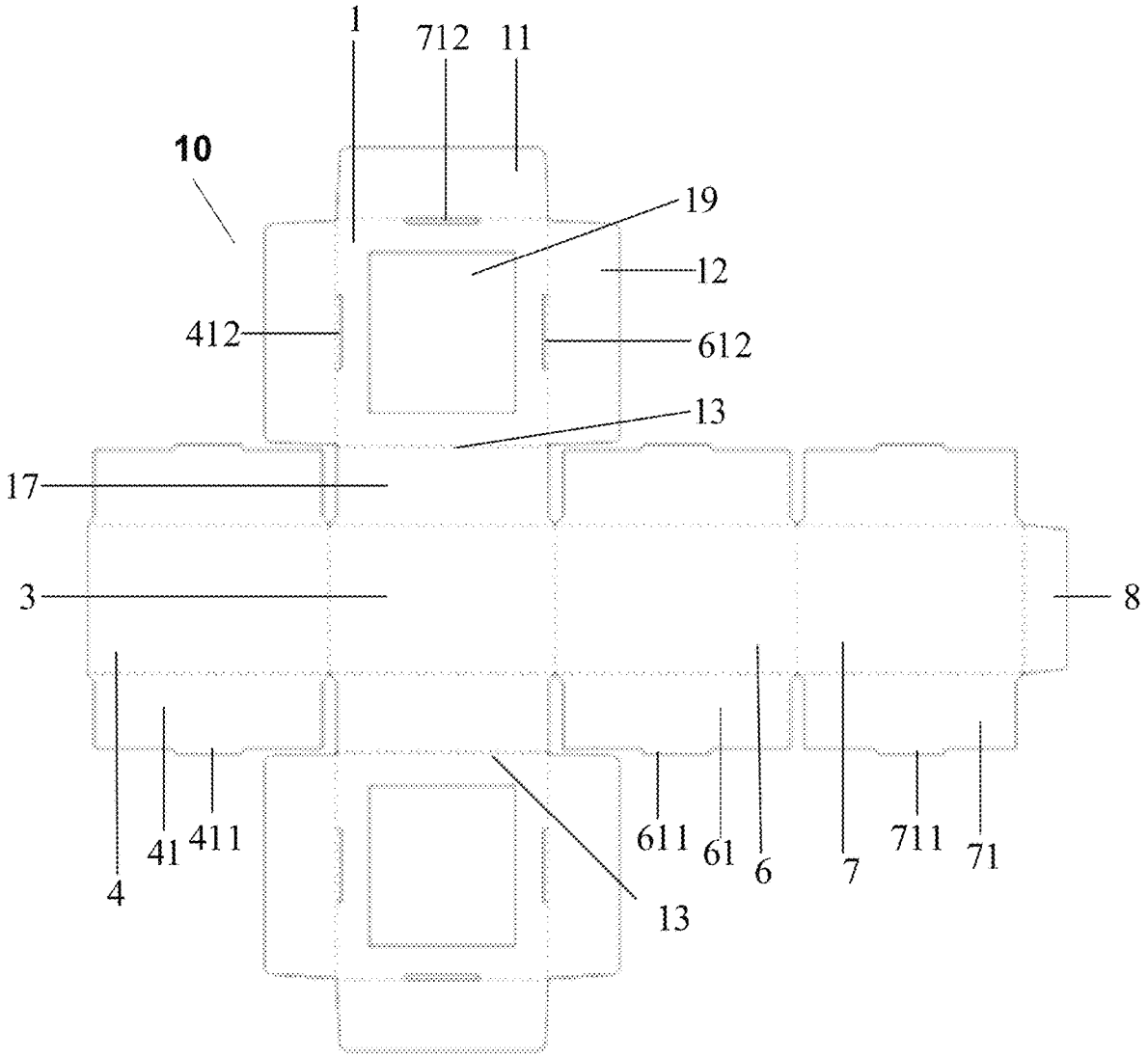
FIG. 6A to FIG. 6E are schematic diagrams illustrating an exemplary process for using a packaging apparatus according to some embodiments of the present disclosure.

FIG. 6A is a schematic diagram illustrating an exemplary main body of a packaging apparatus according to some embodiments of the present disclosure. The main body as shown in FIG. 6A may be similar to the main body as shown in FIG. 2. For example, as shown in FIG. 6A, the main body 10 may include the third side plates 17 disposed beside the coupling side edges 13 (i.e., the first side edge) of each of the two base plates 1, and the first folding plate 3 disposed between the two third side plates 17.

Compared with the main body 10 as shown in FIG. 2, the main body 10 may further include a fifth folding plate 4, a sixth folding plate 6, and a seventh folding plate 7 disposed beside the two side edges of the first folding plate 3 in a direction parallel to the first side edge of the base plate 1 (i.e., the coupling side edge 13). For example, the fifth folding plate 4 may be disposed beside one side edge of the first folding plate 3, and the sixth folding plate 6 and the seventh folding plate 7 may be disposed beside the other side edge of the first folding plates in the direction parallel to the first side edge of the base plate 1.

In some embodiments, along a direction perpendicular to an arrangement direction from the fifth folding plate 4 to the seventh folding plate 7, two fifth side plates 41 may be disposed beside two opposite side edges of the fifth folding plate 4, respectively, two sixth side plates 61 may be disposed beside two opposite side edges of the sixth folding plate 6, respectively, and two seventh side plates 71 may be disposed beside two opposite side edges of the seventh folding plate, respectively. In some embodiments, the fifth side plate 41, the sixth side plate 61, and the seventh side plate 71 that are located at the same side of the fifth side plate 41, the sixth side plate 61, and the seventh side plate 71 may be apart from each other. For example, a notch may be configured between every two adjacent side plates among the fifth side plate 41, the sixth side plate 61, and the seventh side plate 71 to separate the two adjacent side plates. The notch configured between two adjacent side plates among the fifth side plate 41, the sixth side plate 61, and the seventh side plate 71 may face toward the base plate 1. As another example, a cutting line may be configured between every two adjacent side plates among the fifth side plate 41, the sixth side plate 61, and the seventh side plate 71 and used to separate the every two adjacent side plates.

In some embodiments, as long as the first folding plate 3, the fifth folding plate 4, the sixth folding plate 6, and the seventh folding plate 7 are disposed beside in the direction parallel to the coupling side edge 13, positions of the fifth folding plate 4, the sixth folding plate 6, and the seventh folding plate 7 relative to the first folding plate 3 may be adjusted randomly. The present disclosure may not limit the positions of the positions of the fifth folding plate 4, the sixth folding plate 6, and the seventh folding plate 7 relative to the first folding plate 3.

In some embodiments, two folding plates may be disposed beside a second side edge of the first folding plate 3, and one single folding plate may be disposed beside a first side edge of the first folding plate 3. The first side edge and the second side edge may be substantially perpendicular to the coupling side edge 13. For example, as shown in 6A, the fifth folding plate 4 may be disposed beside the first side edge of the first folding plate 3, and the sixth folding plate 6 and the seventh folding plate 7 may be sequentially disposed beside the second side edge that is opposite to the first side edge of the first folding plate 3.

In some embodiments, two folding plates may be disposed beside the first side edge of the first folding plate 3, and one single folding plate may be disposed beside the second side edge of the first folding plate 3. For example, the fifth folding plate 4 and the sixth folding plate 6 may be disposed beside the first side edge of the first folding plate 3, and the seventh folding plate 7 may be disposed beside the second side edge of the first folding plate 3.

In some embodiments, the three folding plates (i.e., the fifth folding plate 4, the sixth folding plate 6, and the seventh folding plate 7) may be disposed beside the same side edge of the first folding plate 3. For example, the fifth folding plate 4, the sixth folding plate 6, and the seventh folding plate 7 may be disposed on the first side edge or second side edge of the first folding plate 3 in sequence.

In some embodiments, the main body 10 may further include a connecting plate 8 disposed beside at least one of two folding plates that are located at ends of the first folding board 3, the fifth folding plate 4, the sixth folding plate 6 and the seventh folding plate 7 in the direction parallel to the coupling side edge 13. The connecting plate 8 may be used to connect the two folding plates that located are at ends of the first folding board 3, the fifth folding plate 4, the sixth folding plate 6 and the seventh folding plate 7 in the direction parallel to the coupling side edge 13. For example, if the fifth folding plate 4 and the seventh folding plate 7 are the two folding plates that are at ends in the direction parallel to the coupling side edge 13, the connecting plate 8 may be disposed beside the fifth folding plate 4, the seventh folding plate 7, or both the fifth folding plate 4 and the seventh folding plate 7.

As shown in FIG. 6A, the connecting plate 8 may be disposed beside the seventh folding plate 7, for example, at a side edge of the seventh folding plate 7. The connecting plate 8 may be folded along the side edge of the seventh folding plate 7 toward the backside of the base plate 1, for example, until substantially perpendicular to the seventh folding plate 7. By folding the fifth folding plate 4, the first folding plate 3, the sixth folding plate 6, and the seventh folding plate 7 toward the backside of the base plate 1, the connecting plate 8 disposed beside the seventh folding plate 7 may be physically connected with the fifth folding plate 4. In some embodiments, the connecting plate 8 may be physically connected with the fifth folding plate 4 by bonding, clamping, or the like. In some embodiments, when the connecting plate 8 is connected with the fifth folding plate 4 by bonding, an adhesive may be provided at corresponding positions of the connecting plate 8 and the second folding plate 14, respectively. The adhesive may include Velcro or adhesive substance. In some embodiments, when the connecting plate 8 is connected with the fifth folding plate 4 by clamping, a slot may be provided at a position of the fifth folding plate 4 corresponding the connecting plate 8, and the connecting plate 8 may be extended into the slot, thereby realizing a connection between the connecting plate 8 and the fifth folding plate 4.

Figure 6B:
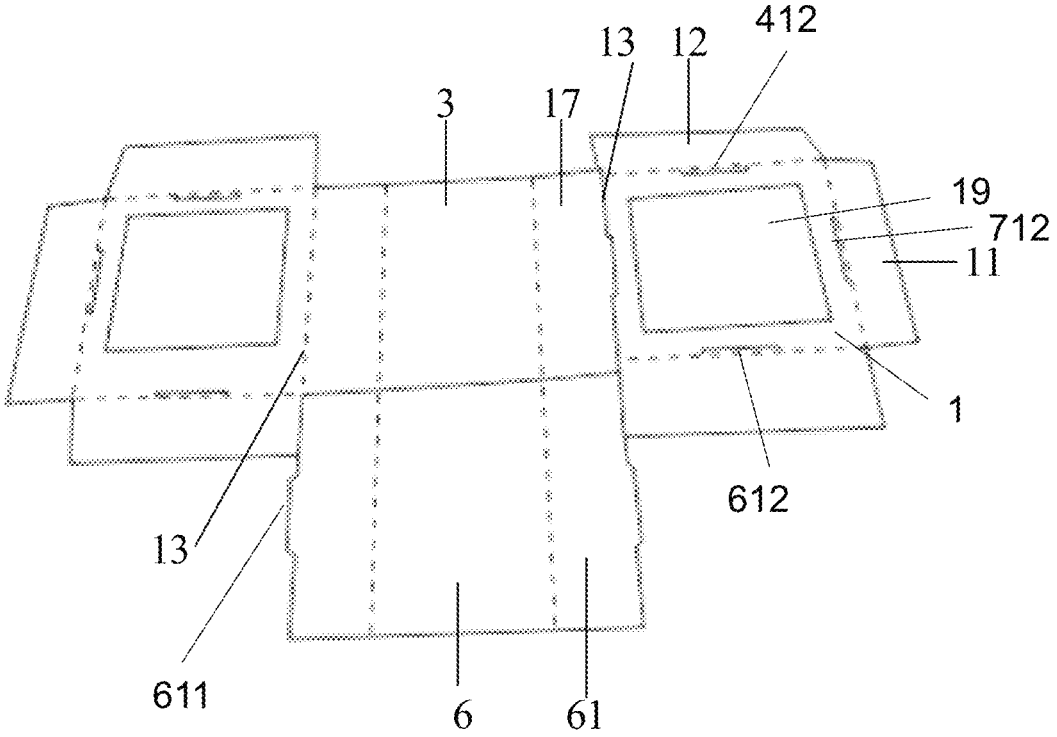
Figure 6C:
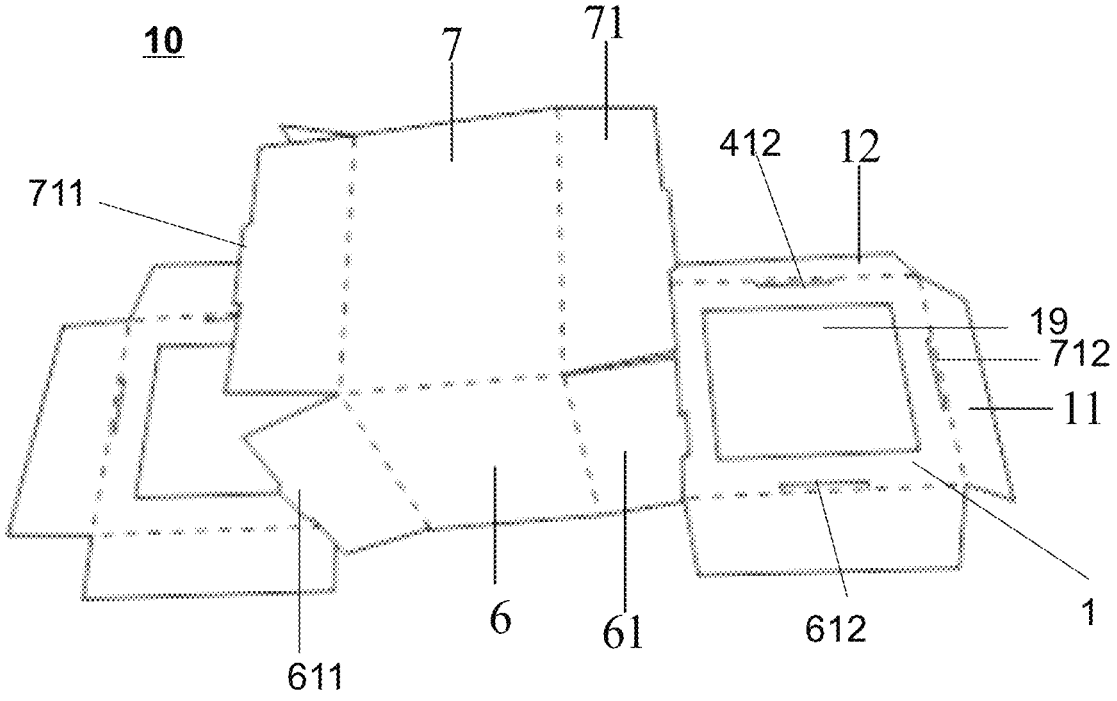
Figure 6D:
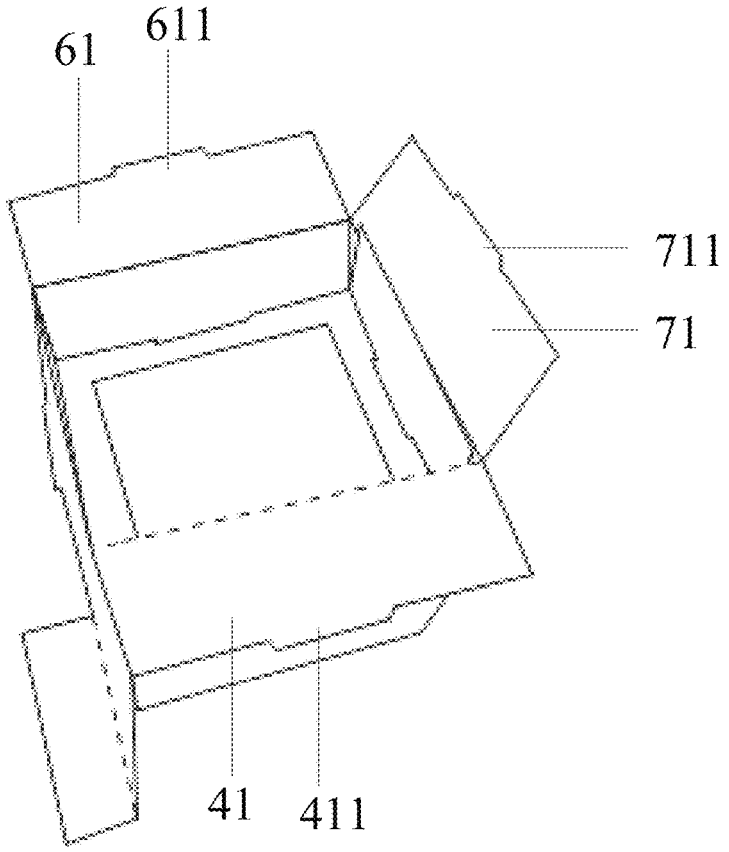

FIG. 6B to FIG. 6E are schematic diagrams illustrating an exemplary process for using a packaging apparatus as shown in FIG. 6A according to some embodiments of the present disclosure. In a folding state of the main body 10, as shown in FIG. 6B-6C, the fifth folding plate 4, the first folding plate 3, the sixth folding plate 6, and the seventh folding plate 7 may form a hollow cube or an approximate hollow cube, also referred to as a first portion of the packaging apparatus. During folding the main body 10, the fifth folding plate 4, the first folding plate 3, the sixth folding plate 6, and the seventh folding plate 7 may be folded in sequence toward the backside of the base plate 1, for example, until substantially perpendicular to their respective adjacent folding plates, thereby forming a hollow cube (or approximate hollow cube). And then the seventh folding plate 7 and the fifth folding plate 4 may be physically connected. Specifically, the seventh folding plate 7 and the fifth folding plate 4 may be physically connected via the connecting plate 8. The first side plates 11, the second side plates 12, the second folding plates 14, the third folding plates 15, and the third side plates 17 associated with the two base plates may be folded as described in FIG. 2 to form a second portion of the packaging apparatus and a third portion of the packaging apparatus. For example, two second side plates 12, the first side plate 11, and the third side plate 17 disposed beside each base plate 1 may be respectively folded toward the front side of the corresponding base plate 1, for example, until substantially perpendicular to the corresponding base plate 1. The two base plates 1 may be folded toward the inside of the hollow cube along the side edges of the first folding plate 1 to be attached and the third folding plates 17 may be attached with the first folding plate 3 as shown in FIG. 6D.

Figure 6E:
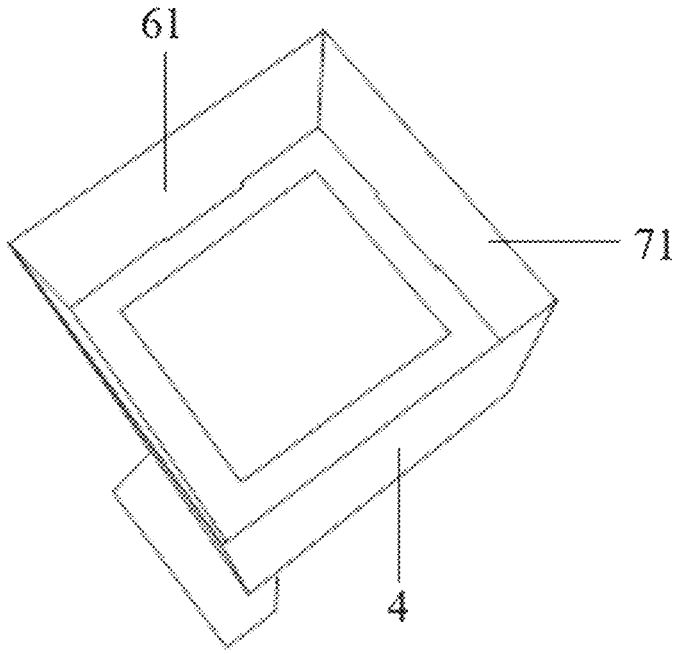

The fifth side plate 41, the sixth side plate 61, and the seventh side plates 71 may be folded toward the inside of the hollow cube. As shown in FIG. 6E, the fifth side plate 41 may be folded toward the inside of the hollow cube along the fifth folding plate 4, for example, until substantially parallel with or attached with the fifth folding plate 4. The third side plate 17 may be folded toward the inside of the hollow cube along the first folding plate 3, for example, until substantially parallel with or attached with the first folding plate 3. The sixth side plate 61 may be folded toward the inside of the hollow cube along the sixth folding plate 6, for example, until substantially parallel with or attached with the sixth folding plate 6. The seventh side plate 71 may be folded toward the inside of the hollow cube along the seventh folding plate 7, for example, until substantially parallel with or attached with the seventh folding plate 7.

As shown in FIGS. 6D-6E, when the side plates, the folding plates, and the two base plates 1 are all in a folding state, the first side plate 11 and two second side plates 12 of each base plate 1 may be attached with the fifth side plate 41, the sixth side plate 61, and the seventh side plate 71. The first side plate 11, the second side plates 12, and the third side plate 17 associated with each of the two base plates 1 may form a sidewall of the packaging apparatus. The fifth folding plate 4, the first folding plate 3, the sixth folding plate 6, and the seventh folding plate 7 may form a cube for covering sidewalls corresponding to the two base plates 1, which may be used to wrap the two base plates 1 in the folding state, and the connecting plate 8 and the fifth folding plate 4 may be physically connected to limit the movement of the seventh folding plate 7.

In some embodiments, the main body 10 may further include a second coupling component 712 disposed between the first side plate 11 and the base plate 1, a third coupling component 412 disposed between the base plate 1 and one of the second side plates 12, and a fourth coupling component 612 disposed between the base plate 1 and the other one of the second side plates 12. The main body 10 may further include a second matching component 411 disposed beside at least one of two side edges of the fifth side plate 41 to match the third coupling component 412, a third matching component 611 disposed beside at least one of two side edges of the sixth side plate 61 to match the fourth coupling component 612, and a fourth matching component 711 disposed beside at least one of two side edges of the seventh side plate 71 to match the second coupling component 712. In some embodiments, the second coupling component 712, the third coupling component 412, and/or the fourth coupling component 612 may include holes. The second matching component 411, the third matching component 611, and the fourth coupling component may include extending parts, each of which may match the corresponding holes. In some embodiments, a matching component may match a coupling component by bonding. For example, the second matching component 411 may match the third coupling component 412 using Velcro or double-sided tape.

Referring to FIGS. 6A-6E, an exemplary method for folding a packaging apparatus may be described herein. First, the fifth folding plate 4, the first folding plate 3, the sixth folding plate 6, and the seventh folding plate 7 may be sequentially folded toward the backside of the base plates 1, for example, until substantially perpendicular to their respective adjacent folding plates, thereby forming a hollow cube. The connecting plate 8 may be physically connected with the fifth folding plate 4, for example, by bonding. Then, the first side plate 11, the second side plate 12, and the third side plate 17 may be folded, for example, until substantially perpendicular to the base plates 1. The two third side plates 17 may be folded to be attached with the first folding plate 3. The backsides of the two base plates 1 may be attached, and may be located inside the hollow cube. Further, the fifth side plate 41, the sixth side plate 61, and the seventh side plate 71 may be folded to be attached to the fifth folding plate 4, the sixth folding plate 6 and the seventh folding plate 7, respectively, and the first side plate 11 and the second side plate 12 may be clamped to fix the base plate 1. In addition, the second matching component 411, the third matching component 611, and the fourth matching component 711 may be inserted into the corresponding third coupling component 412, the fourth coupling component 612, and the second coupling component 712, respectively, to further fix the two base plates 1.

Figure 7A:
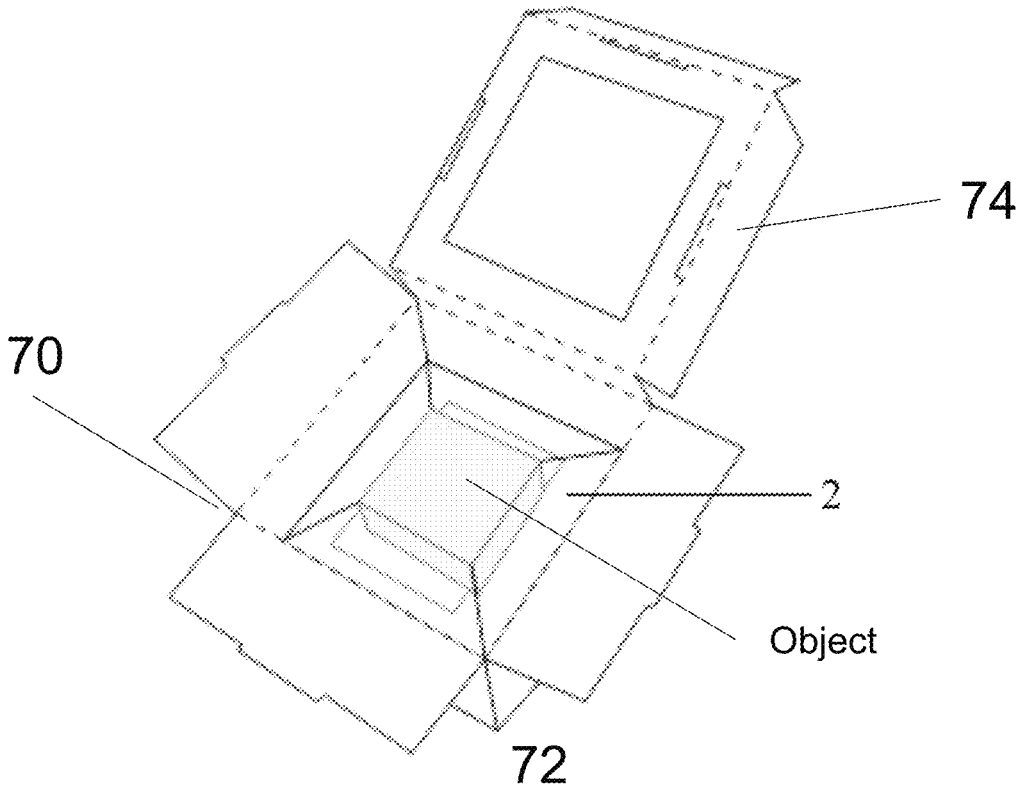
FIGS. 7A to 7B are schematic diagrams illustrating an exemplary process for using a packaging apparatus as shown in FIG. 6A according to some embodiments of the present disclosure.
Figure 7B:
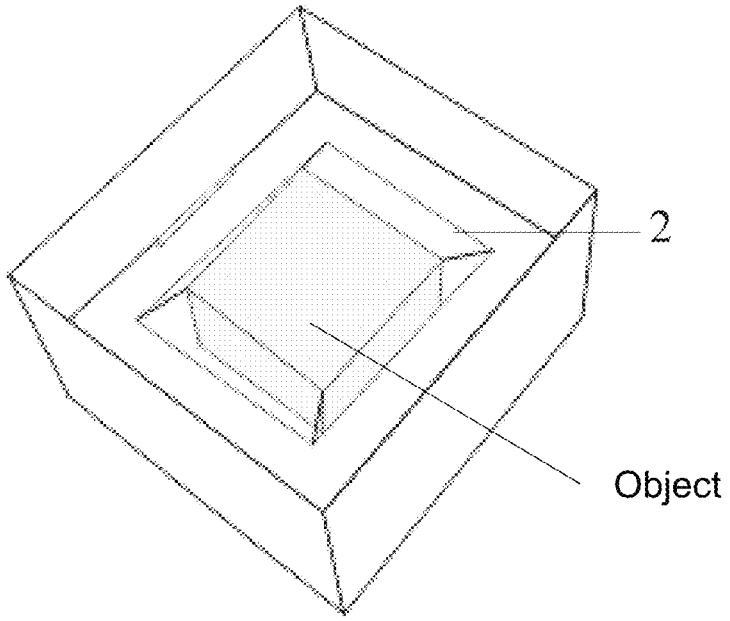

FIGS. 7A to 7B are schematic diagrams illustrating an exemplary process for using a packaging apparatus as shown in FIG. 6A to packaging an object according to some embodiments of the present disclosure. In the application of the packaging apparatus, the packaging apparatus may be folded to form a hollow cube (also referred to as a first portion 70 of the packaging apparatus) in a manner as described in FIG. 6B to FIG. 6E. One base plate 1 and the side plates (e.g., the first side plate 11 and the second side plates 12) associated with the base plate 1 may be folded to form a second portion 72 of the packaging apparatus and disposed in the hollow cube as shown in FIG. 7A. An object may be located at the elastic sheet of the second portion of the packaging apparatus. Another one base plate 1 and the side plates (e.g., the first side plate 11 and the second side plates 12) associated with the base plate 1 may be folded to form a third portion 74 of the packaging apparatus. After the object is located in the hollow tube, the third portion 74 of the packaging apparatus may be folded and disposed in the first portion 70 of the packaging apparatus (i.e., the hollow tube). The backsides of the two base plates 1 in the folding state may be folded toward the inside of the hollow cube, until the backsides of the two base plates 1 may be attached to package the object as shown in FIG. 5B. The object may be wrapped and supported by the elastic sheets 2 on the base plates, and may be completely suspended in a packaging box.

It should be noted that the above descriptions regarding the folding process of the packaging apparatus are merely provided for illustration, and not intend to be limiting. In some embodiments, an order for folding various components of the packaging apparatus may be adjusted randomly, as long as it may achieve the folding state of the packaging apparatus.

Figure 8:
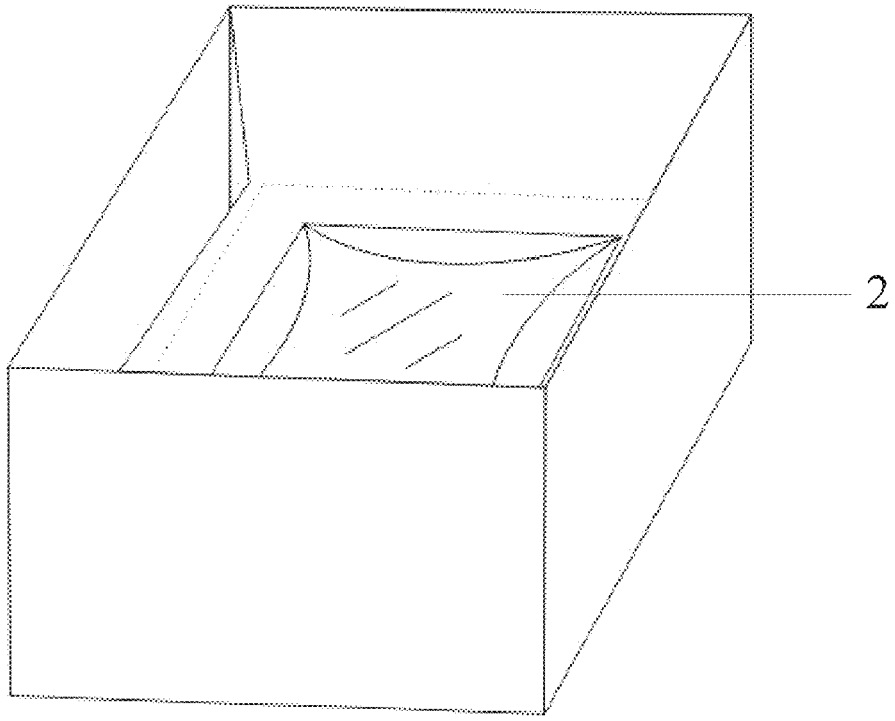
FIGS. 8 and 9 are schematic diagrams illustrating an exemplary folded packaging apparatus according to some embodiments of the present disclosure.
Figure 9:
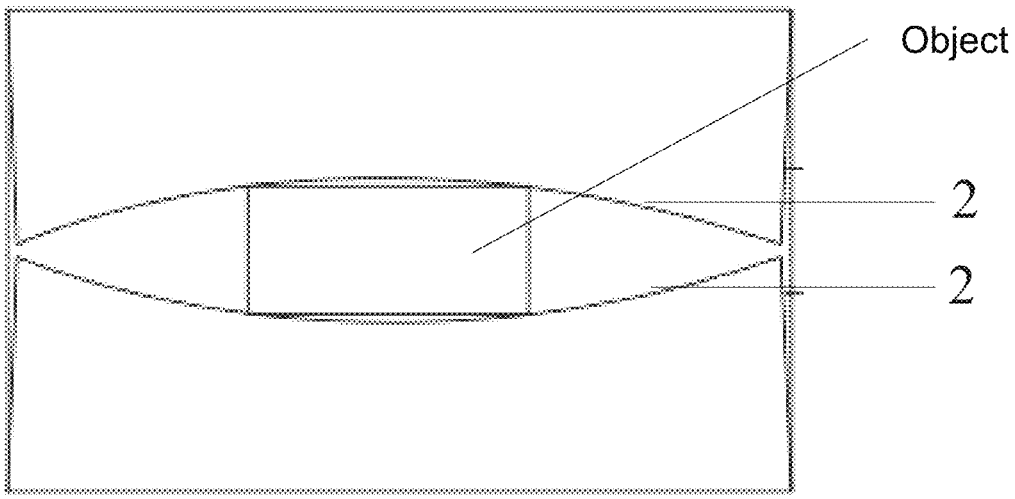

FIGS. 8 and 9 are schematic diagrams illustrating an exemplary folded packaging apparatus according to some embodiments of the present disclosure. As shown in FIGS. 8 and 9, the elastic sheets 2 of the two base plates 1 after being folded in half may be attached with or close to each other. Due to the openings on the two base plates 1, a packaging space may be formed between the elastic sheet 2. The object may be located between the two elastic sheets 2, and then the two elastic sheets 2 may be stretched as the object with a certain size and weight. The stretched elastic sheet 2 may wrap and support the object, so that the object may be suspended in a packaging box. The packaging structure may be used to package objects in various irregular shapes, and may eliminate difficulties in the production line assembly due to the irregular shapes. Moreover, since the object is wrapped by the elastic sheets 2, the elastic sheets 2 that wrap the periphery of the object may have a moisture-proof effect. In addition, the packaging structure may support multi-form interiors, thereby achieving strong versatility.

In some embodiments, the main body 10 may include one single base plate 1. In the application of the packaging structure, two main bodies 10 may be folded and two base plates 1 of the two main bodies may then be physically connected to package the object. In some embodiments, when the main body 10 includes one single base plate 1, the base plate 1, the surrounding side plates, and folding plates may be configured as shown in FIGS. 1 and 2. The first folding plate 3 and/or the third side plate 17 as shown in FIG. 2 may not be needed. The specific structure of the main body with only one base plate will be described in detail below as described in connection with FIG. 10-13C.

Figure 10:
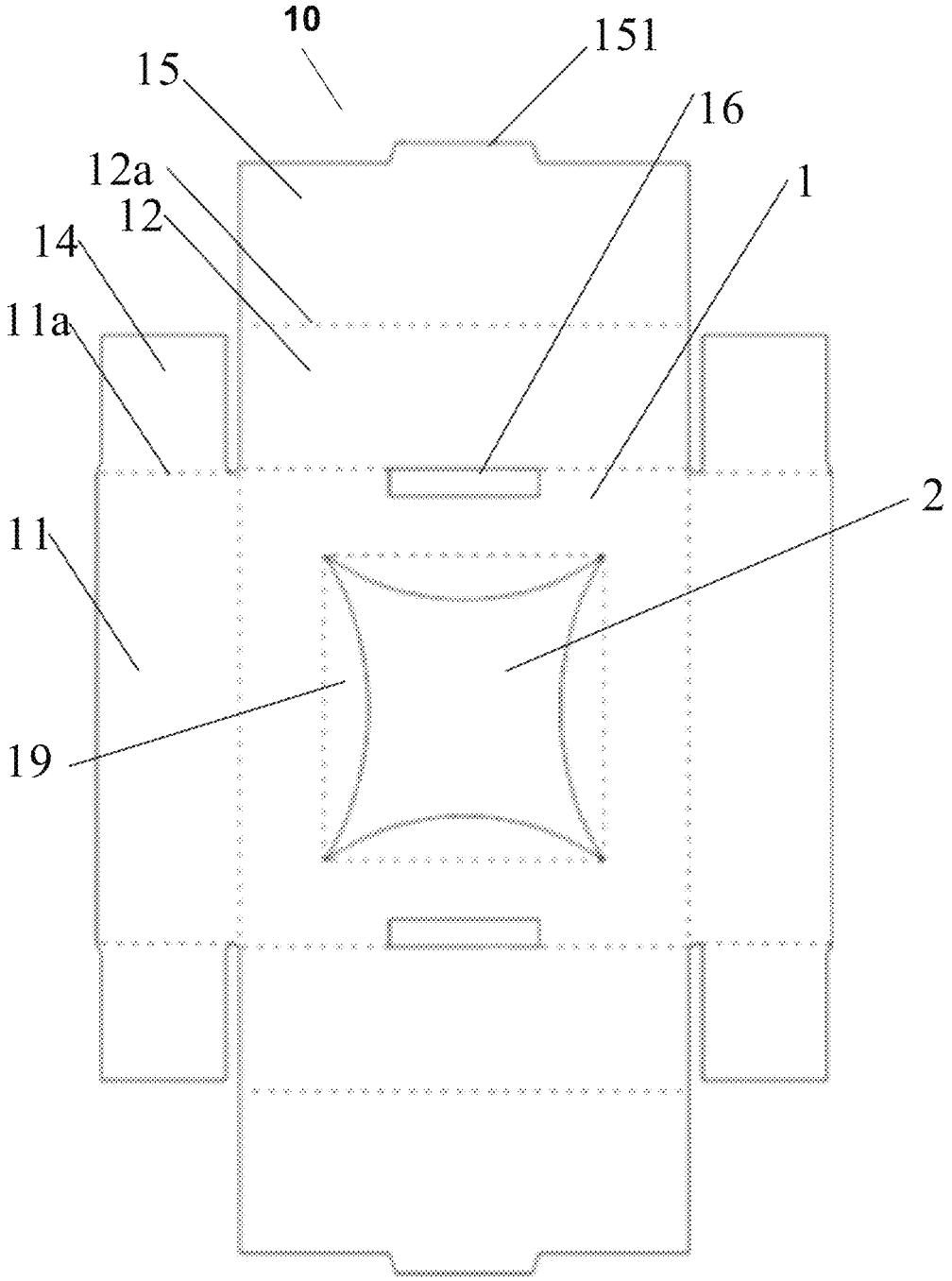
FIG. 10 is a schematic diagram illustrating an exemplary main body of a packaging apparatus according to some embodiments of the present disclosure.
Figure 11:
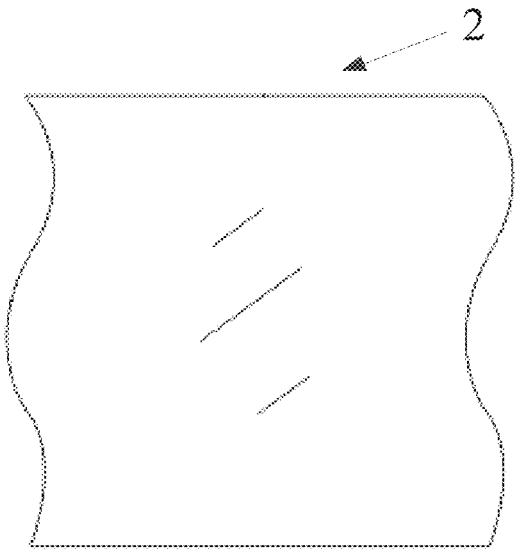
FIG. 11 is a schematic diagram illustrating an exemplary elastic sheet according to some embodiments of the present disclosure.

FIG. 10 is a schematic diagram illustrating a main body of an exemplary packaging apparatus according to some embodiments of the present disclosure. The packaging apparatus may include two main bodies 10 and two elastic sheets 2 as shown in FIG. 10. Each of the two elastic sheets 2 may be connected with one of the two main bodies 10. FIG. 11 is a schematic diagram illustrating an exemplary elastic sheet according to some embodiments of the present disclosure. As shown in FIG. 10, the main body 10 may include one base plate 1 in a quadrangular shape. A first side plate 11 may be disposed beside at least one of two opposite side edges of the base plate 1, and a second side plate 12 may be disposed beside at least one of other two opposite side edges of the base plate 1. The main body 10 may also include an opening at the center region of the main body 10. The periphery of the elastic sheet 2 may be physically connected with the base plate 1 around the opening. When the two first side plates 11 and the two second side plates 12 are respectively folded along the corresponding side edges of the base plate 1, until substantially perpendicular to the base plate 1, the above four side plates may form a sidewall substantially perpendicular to the base plate 1.

The packaging apparatus may include two main bodies 10 each of which includes one base plate. Each of the two main bodies 10 may be folded as shown in FIGS. 12A-12D to form two portions of the packaging apparatus (e.g., a first portion 1300 and a second portion 1350 as shown in FIG. 13B). After the two main bodies 10 are folded, an object may be placed on one of the two elastic sheets 2 in the first portion 1300, and the second portion 1350 may be placed on the first portion 1300, such that the two base plates 1 are attached and the two elastic sheets 2 may wrap and cover the object. The two main bodies 10 may be physically connected. The object may be located and/or positioned between the two elastic sheets 2, which makes the object be suspended in the packaging apparatus as shown in FIG. 13A-13C. The above-mentioned main body including one single base plate may not only be suitable for objects in irregular shapes, but also have a moisture-proof function.

It should be noted that the elastic sheet 2 may be physically connected with the front side of the base plate 1 or the backside of the base plate 1. Preferably, the elastic sheet 2 may be physically connected with or fixed to the backside of the base plate 1. When the object is placed between the two elastic sheets 2, the object may generate a certain pressure on the two elastic sheets 2. Fixing the elastic sheet 2 on the backside of the base plate 1 may be more conducive to fixing the elastic sheet 2 on the base plates 1.

In some embodiments, the elastic sheet 2 may be physically connected with the base plate 1, for example, by an adhesive.

As shown in FIG. 10, the main body 10 may include one or more second folding plates 14 disposed beside ends of the first side plate 11 along a direction parallel to the first side edge, and a first folding line 11*a* may be disposed between each of the second folding plates 14 and the first side plate 11. One or more third folding plates 15 may be disposed beside the second side plate 12, and a second folding line 12*a* may be disposed between each of the third folding plates 15 and the second side plate 12.

Each of the second folding plates 14 may be folded along the first folding line 11*a* toward the front side of the base plate 1, until substantially perpendicular to the first side plate 11. Each of the third folding plates 15 may be folded along the second folding line 12*a* toward the front side of the base plate 1, until substantially perpendicular to the first side plate 11. When the first side plate 11 and the second side plate 12 are folded to be substantially perpendicular to the base plate 1, and the third folding plate 15 is folded to be attached to the corresponding second side plate 12, each of the second folding plates 14 may be extended between the second side plate 12 and the third folding plate 15 on the same side, thereby limiting the movement of the first side plate 11.

In some embodiments, the main body 10 may further include a first coupling component 16 provided between each of the second side plates 12 and the base plate 1, and a first matching component 151 disposed beside each of the third folding plates 15. When the second side plate 12 is folded to be perpendicular to the base plate 1 and the third folding plate 15 is folded to be attached with the second side plate 12, the first matching component 151 may match and connected with the first coupling component 16. In some embodiments, the first matching component 151 may include an extending part, and the first coupling component 16 may be a hole matching the extending part. The first matching component 151 may be embedded into the first coupling component 16 to connect the third folding plate 15 with the base plate 1. In some embodiments, the first matching component 151 may match the first coupling component 16 by bonding. For example, the first matching component 151 may match the first coupling component 16 using Velcro or double-sided tape.

Figure 12A:
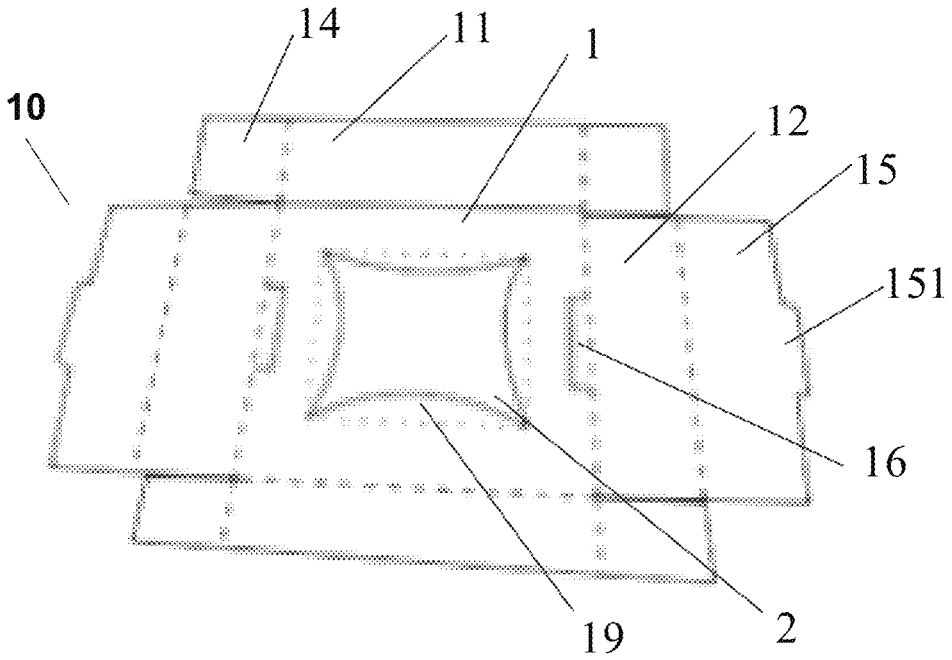
FIGS. 12A-12D are schematic diagrams illustrating an exemplary process for using a packaging apparatus according to some embodiments of the present disclosure.
Figure 12B:
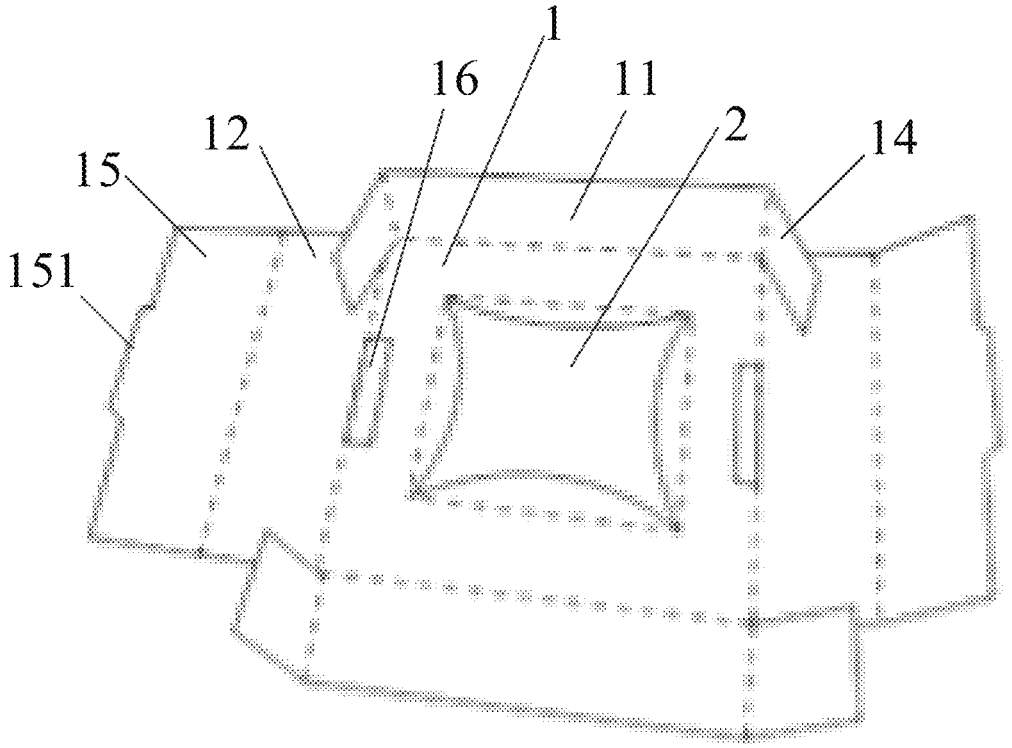
Figure 12C:
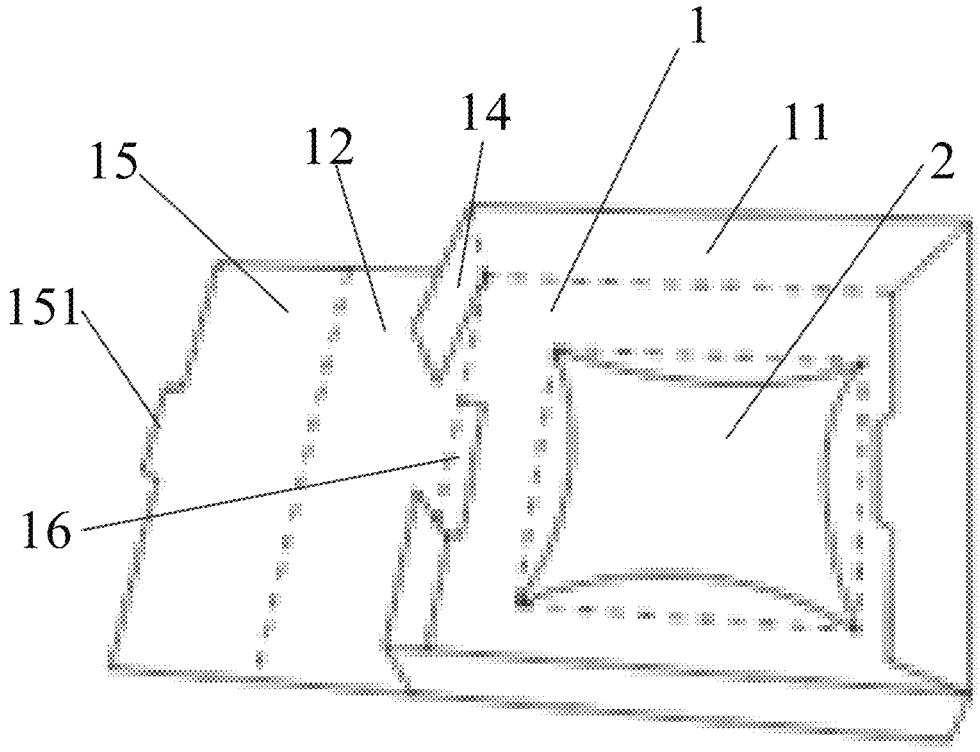
Figure 12D:
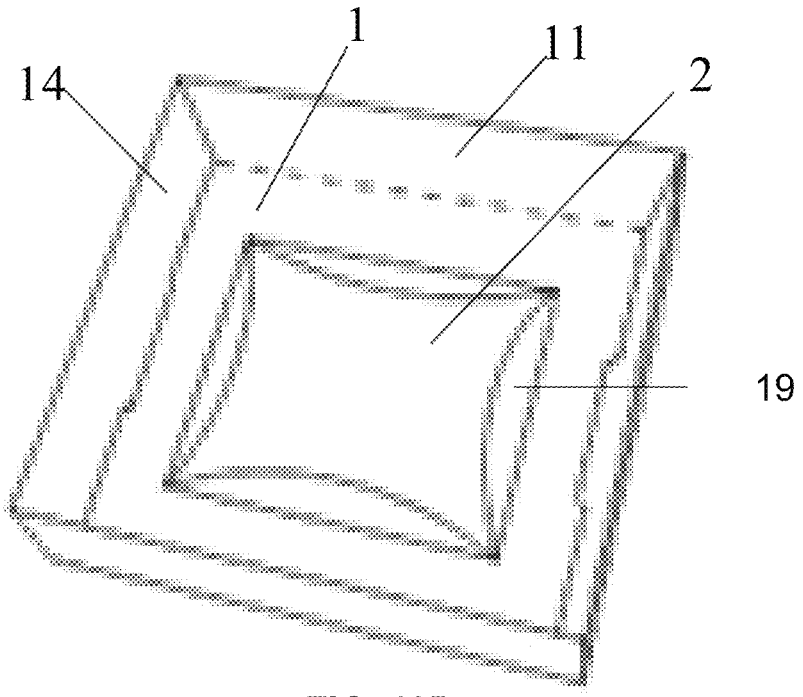
Figure 13A:
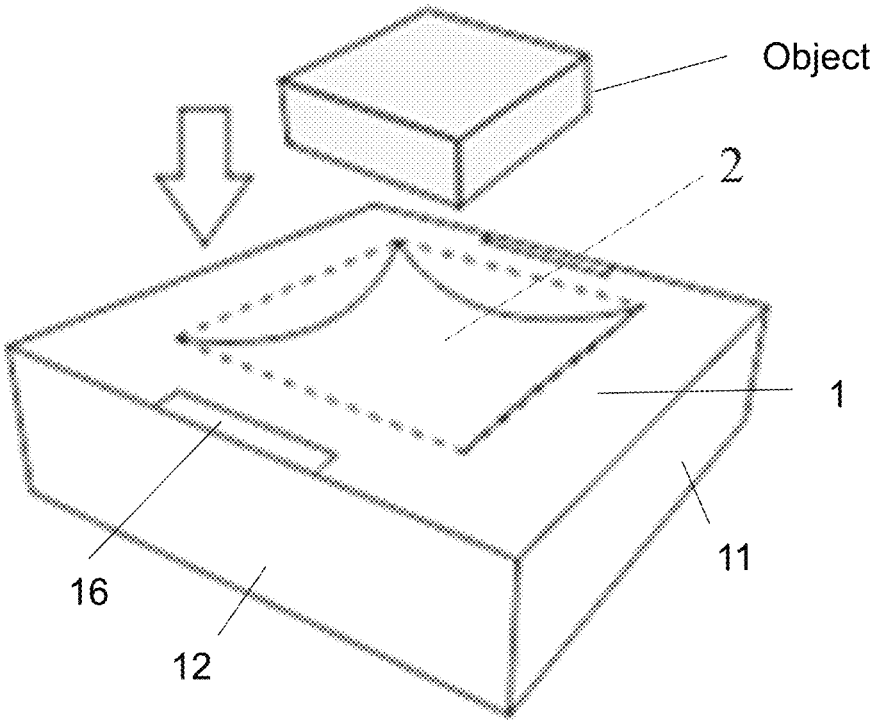
FIGS. 13A-13C are schematic diagrams illustrating an exemplary process for using a packaging apparatus as shown in FIG. 12D according to some embodiments of the present disclosure.
Figure 13B:
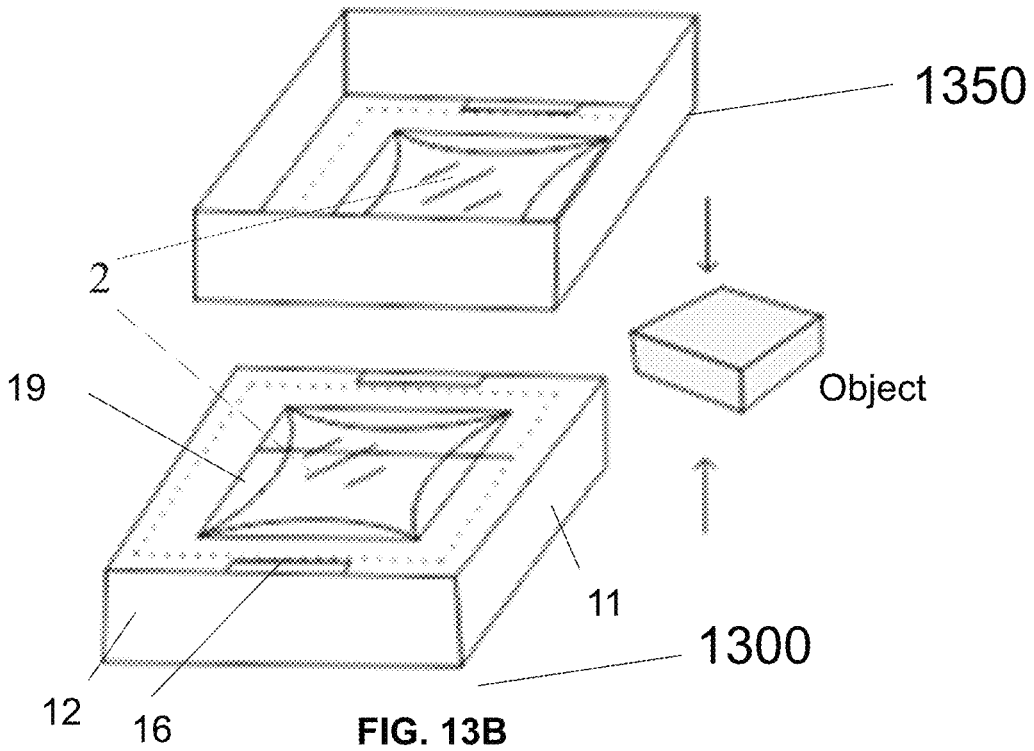
Figure 13C:
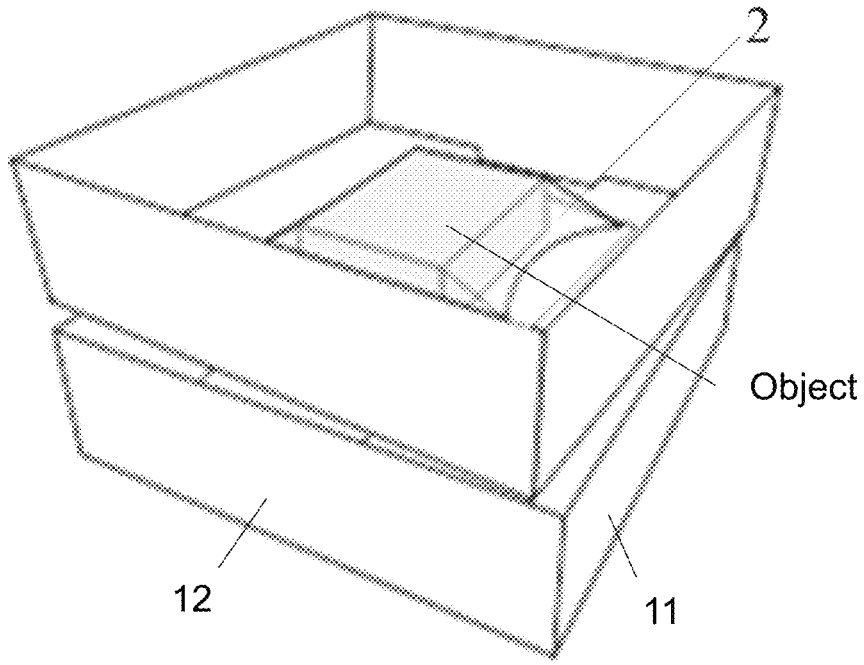

FIG. 12A to FIG. 13C are schematic diagrams illustrating an exemplary process for using a packaging apparatus as shown in FIG. 12A according to some embodiments of the present disclosure. As shown in FIG. 12A to FIG. 12D, in the application of the packaging apparatus, the first side plate 11 may be folded, until substantially perpendicular to the base plate 1. Each of the second folding plates 14 may be folded toward the base plate 1, until substantially perpendicular to the first side plate 11. The second side plate 12 may be folded, until substantially perpendicular to the base plate 1. Each of the third folding plates 15 may be folded toward the front side of the base plate 1 to be attached to the second side plate 12. Each of the second folding plates 14 may be embedded between the second side plate 12 and the third folding plate 15, thereby fixing the first side plate 11 and the second side plate 12. When the third folding plate 15 is folded to be attached to the second side plate 12, the first matching component 151 on the second side plate 12 may be inserted into the first coupling component 16 to fix the base plate 1 and the second side plate 12.

It should be noted that the above descriptions regarding the application of the packaging apparatus are merely an example for illustration. In some embodiments, the second side plate 12 and the third folding plate 15 may firstly be folded. After the first matching component 151 matches and connected with the first coupling component 16, the first side plate 11 and the second folding plate 14 may then be folded, so that the second folding plate 14 may extend between the second side plate 12 and the third folding plate 15. The above packaging apparatus may have a simple structure and good stability.

When the main body 10 includes one base plate 1, in some alternative embodiments, two second side plates 12 and one first side plate 11 may be disposed beside the periphery of the base plate 1. The second folding plate 14 may be disposed on ends of one of the first side plates 11, and the third folding plates 15 may be disposed beside the second side plate 12. In a folding state, the second folding plate 14 may still be extended between the second side plate 12 and the third folding plate 15 to fix the first side plate 11.

The abovementioned application of the packaging apparatuses may need to be folded for multiple times, for example, folding the side plates or folding plates for multiple times. Some embodiments of the present disclosure may also provide an application of a packaging apparatus that can be quickly folded.

Figure 14:
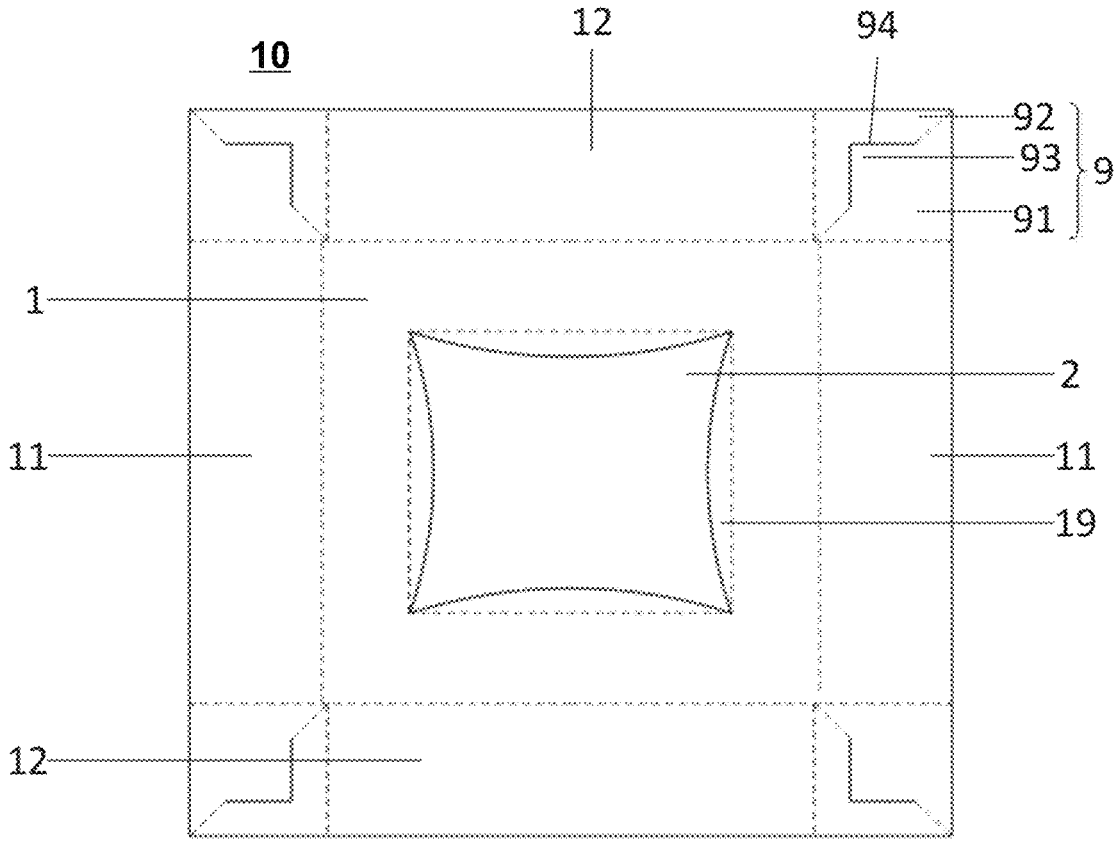
FIG. 14 is a schematic diagram illustrating an exemplary main body of a packaging apparatus in an unfolded state according to some embodiments of the present disclosure.
Figure 15:
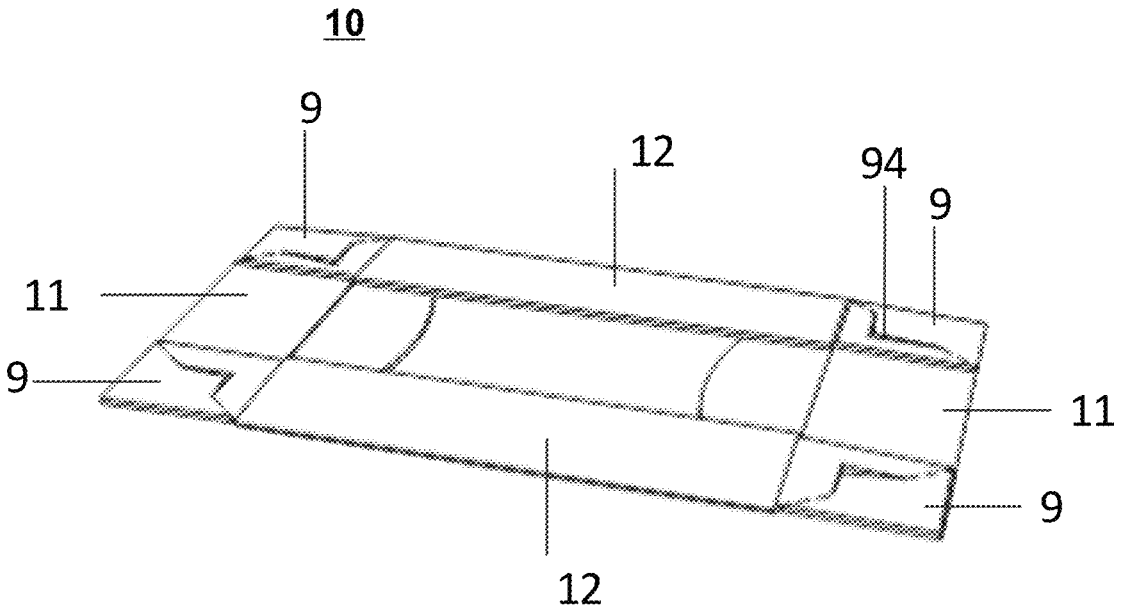
FIG. 15 is a schematic diagram illustrating the main body as shown in FIG. 14 in a partially folded state according to some embodiments of the present disclosure.
Figure 16:
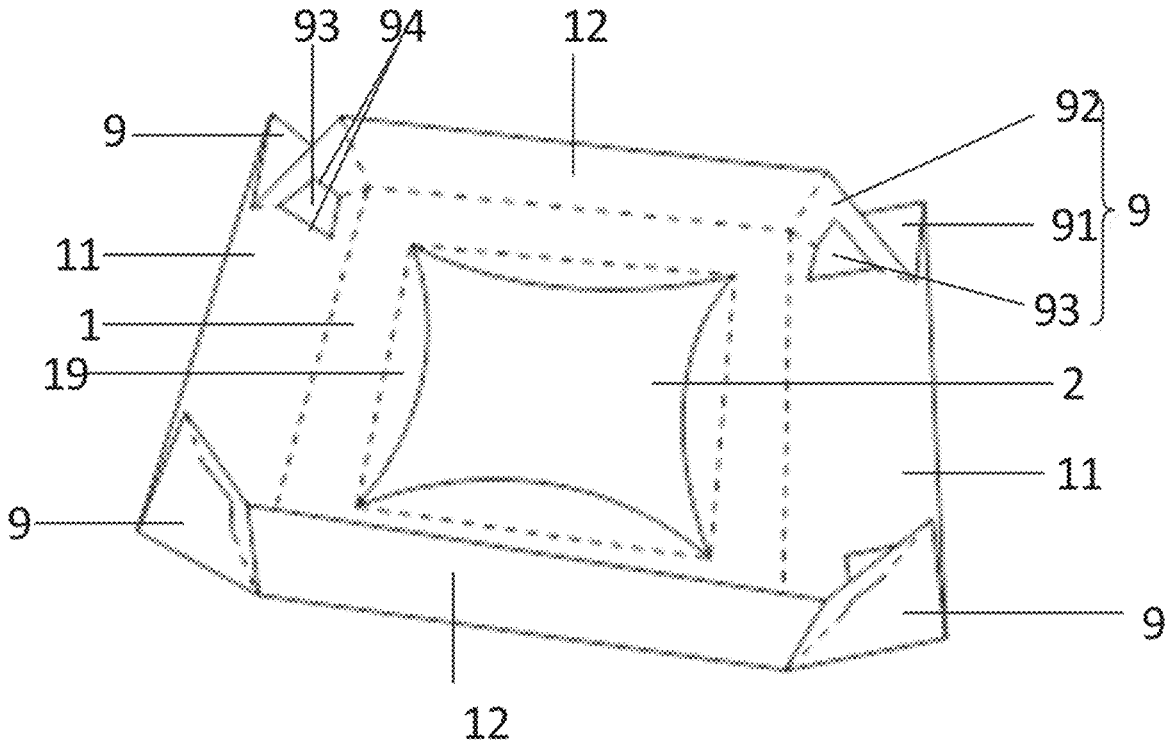
FIG. 16 is a schematic diagram illustrating the main body as shown in FIG. 14 in a partially folded state according to some embodiments of the present disclosure.
Figure 17:
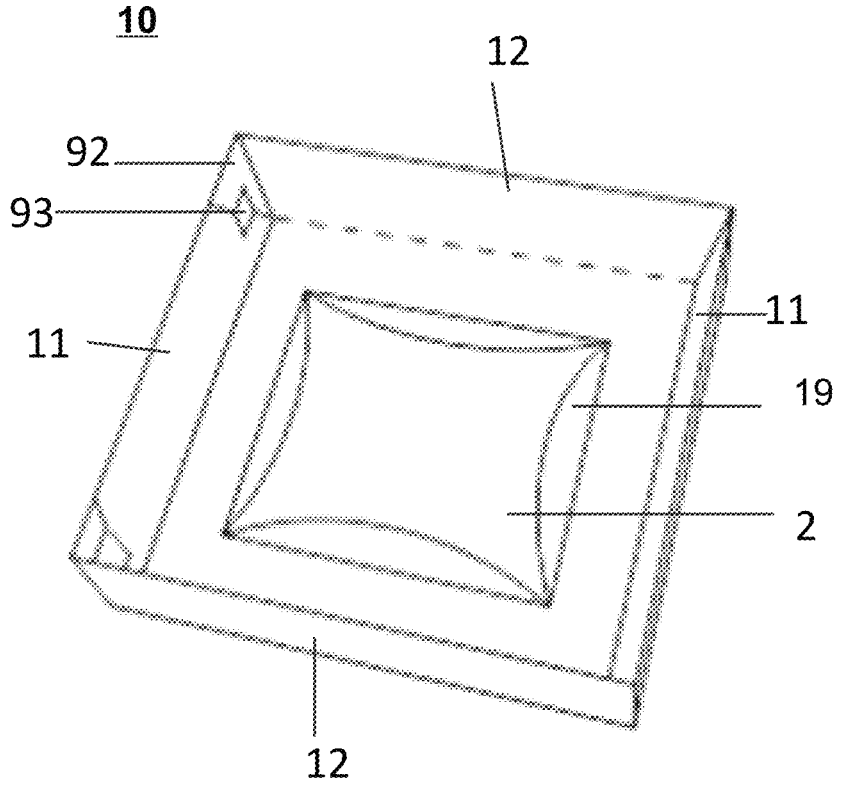
FIG. 17 is a schematic diagram illustrating the main body as shown in FIG. 14 in a folded state according to some embodiments of the present disclosure.

FIG. 14 is a schematic diagram illustrating an exemplary main body of a packaging apparatus in an unfolded state according to some embodiments of the present disclosure. FIG. 15 is a schematic diagram illustrating the main body as shown in FIG. 14 in a partially folded state according to some embodiments of the present disclosure. FIG. 16 is a schematic diagram illustrating the main body as shown in FIG. 14 in a partially folded state according to some embodiments of the present disclosure. FIG. 17 is a schematic diagram illustrating the main body as shown in FIG. 14 in a folded state according to some embodiments of the present disclosure.

In some embodiments, the packaging apparatus may include two main bodies 10 and two elastic sheets 2. Each of the two elastic sheets 2 may be physically connected with one of the two main bodies 10. As shown in FIG. 14 to FIG. 17, the main body 10 may include a base plate 1. The base plate 1 may be rectangular. The base plate 1 may be provided with an opening 19, and the elastic sheet 2 may be physically connected with the main body 10 to cover at least a part of the opening 19. For example, the elastic sheet 2 may be physically connected with the base plate 1 by an adhesive. The base plate 1 may have two opposite first side edges and two opposite second side edges.

The main body 10 may include a first side plate 11 arranged beside each of the first side edges and a second side plate 12 arranged beside each of the second side edges. The first side plate 11 may be folded toward the front side of the base plate 1, for example, until substantially perpendicular to the base plate 1, and the second side plate 12 may be folded toward the front side of the base plate 1, for example, until substantially perpendicular to the base plate 1. In the application of the packaging apparatus, the two main bodies 10 may be folded to form two portions of the packaging apparatus (e.g., the first portion 1300 and the second portion 1350 as shown in FIG. 13B). The base plates of the two main bodies 10 may be physically connected, and a space for accommodating an object may be formed between the elastic sheets 2 disposed on the two main bodies 10.

As shown in FIG. 14, in some embodiments, the main body 10 may include a corner plate 9 disposed at each of four top corners of the base plate 1. The corner plate 9 may be disposed between the adjacent first side plate 11 and second side plate 12. The corner plate 9 in FIG. 14 may be rectangular. A side of the corner plate 9 in a direction parallel to the first side edge may be equal to a side of the second side plate 12 in the direction parallel to the first side edge. The size of the corner plate 9 in a direction parallel to the second side edge may be equal to the size of the first side plate 11 in the direction parallel to the second side edge. Correspondingly, the main body 10 shown in FIG. 14 may be rectangular in an unfolded state.

In some embodiments, the corner plate 9 may include a first portion 91 of the corner plate 9 and a second portion 92 of the corner plate 9. The first portion 91 of the corner plate 9 may be disposed beside the first side plate 11, the second portion 92 of the corner plate 9 may be disposed beside the second side plate 12, and a folding mark may be disposed between the first portion 91 of the corner plate 9 and the second portion 92 of the corner plate 9. In some embodiments, the corner plate 9 may include a cutting line 94 and a protrusion portion 94. In some embodiments, the cutting line 94 may include one or more straight line segments or an arc line. For example, the cutting line 94 may include two straight line segments with any included angle. As another example, the cutting line 94 may include a curve such as an arc-shape curve with a center and a curve in an irregular shape. The cutting line 94 may make the second portion 92 of the corner plate 9 have a groove and the protrusion portion 93 may match the groove.

In the folding state of the main body 10 as shown in FIG. 17, the second portion 92 of the corner plate 9 may be attached to the second side plate 12, and the first portion 91 of the corner plate 9 may be attached to the second portion 92 of the corner plate 9. Alternatively, in the folding state of the main body 10 as shown in FIG. 17, the first portion 91 of the corner plate 9 may be attached to the first side plate 11, and the second portion 92 of the corner plate 9 may be attached to the first portion 91 of the corner plate 9.

As shown in FIGS. 14-17, in the application of the packaging apparatus, the two main bodies 10 may need to be used together. First, the elastic sheet 2 may be pasted on the base plate 1 to ensure that the elastic sheet 2 may cover at least a part of the opening 19 on the base plate 1 as shown in FIG. 14. Then, the main body 10 may be folded. During a folding process, the first side plate 11 may be folded toward the front side of the base plate 1, for example, until substantially attached to the front side of the base plate 1, as shown in FIG. 15. Then, the two first side plates 11 of the main body 10 may be folded to be perpendicular to the base plate 1. As shown in FIG. 16, the second side plates 12 may be folded toward the elastic sheet 2, until substantially perpendicular to the base plate 1. The main body 10 may be in a folding state, as shown in FIG. 17. In some embodiments, the first side plate 11 may be directly folded to be perpendicular to the base plate 1, and then the second side plate 12 may be folded to be perpendicular to the base plate 1.

After the elastic sheet 2 of each main body 10 is pasted, the two first side plates 11 of each main body 10 may be folded, until substantially perpendicular to the base plate 1. The two second side plates 12 of each main body 10 may be folded until substantially perpendicular to the base plate 1. The corner plates 9 may be folded along a folding mark. Assuming that the main body does not include the cutting line 94, the folding process may be implemented in two cases according to actual working conditions or operating habits as below.

In a first case, the second portion 92 of the corner plate 9 may be folded to be attached to the second side plate 12, and the first portion 91 of the corner plate 9 may be folded to be attached to the second portion 92 of the corner plate 9 along the folding mark on the corner plate 9. Then, the first portion 91 of the corner plate 9, the second portion 92 of the corner plate 9, and the second side plate 12 may be relatively physically fixed (for example, by bonding), to fold the main body 10.

In a second case, the first portion 91 of the corner plate 9 may be folded to be attached to the first side plate 11, and the second portion 92 of the corner plate 9 may be folded to be attached to the first portion 91 along the folding mark on the corner plate 9. The first portion 91 of the corner plate 9, the second portion 92 of the corner plate 9, and the second side plate 12 may be relatively physically fixed (for example, by bonding), to fold the main body 10.

In such folding arrangement, the unfolded main portion 10 may include a plate in a rectangular shape, which may be directly folded to form a cube including a bottom and a sidewall on one side without splicing, which further improves the efficiency of manufacturing and application of a packaging apparatus.

In some embodiments, the corner plate 9 may include a cutting line 94. A first end and a second end of the cut line 94 may be disposed on the folding mark. In some embodiments, the cutting line 94 on the corner plate 9 may include one or more straight line segments or an arc line. For example, the cutting line 94 on the corner plate 9 may be two straight line segments perpendicular to each other. In some embodiments, the cutting line 94 may two straight line segments with any included angle. In some embodiments, the included angle between the two straight line segments may be within a range of 15° to 170°. In some embodiments, the included angle between the two straight line segments may be within a range of 30° to 160°. In some embodiments, the included angle between the two straight line segments may be within a range of 45° to 120°. In some embodiments, the included angle between the two straight line segments may be within a range of 60° to 100°. In other embodiments, the cutting line 94 may include more than two straight line segments. In some embodiments, the cutting line 94 may be a curve. The curve may include an arc-shaped curve with a special center, or a curve in an irregular shape. The present disclosure may not limit a shape of the cutting line 94, as long as two ends of the cutting line 94 are disposed on the folding mark of the corner plate 9 and line segments of the cutting line 94 is disposed between the first portion 91 of the corner plate 9 and the second portion 92 of the corner plate 9.

In some embodiments, as shown in FIG. 14 and FIG. 16, the cutting line 94 may be used to generate the first portion 91 and the second portion 92 of the corner plate 9. Correspondingly, the cutting line 94 may make the second portion 92 of the corner plate 9 have a groove, and the first portion 91 of the corner plate 9 may have a protrusion portion 93 that matches the groove. In some embodiments, the cutting line 94 may be disposed on the first portion 91 of the corner plate 9.

Correspondingly, the cutting line 94 may make the first portion 91 of the corner plate 9 have a groove, and the second portion 92 of the corner plate 9 may have a protrusion portion 93 that fits with the groove.

In this embodiment, after the elastic sheet 2 of each main body 10 is pasted, the two first side plates 11 of each main body 10 may be folded in a direction away from the other main body 10, until substantially perpendicular to the base plate 1. The two second side plates 12 of each main body 10 may be folded in a direction away from the other main body 10, until substantially perpendicular to the base plate 1. The corner plate 9 may be folded along the folding mark (or a part thereof). Assuming that the main body includes the cutting line 94, the following folding process may be implemented in two cases, according to actual working conditions or operating habits as below.

In the first case, the second portion 92 of the corner plate 9 may be folded to match the second side plate 12, the first portion 91 of the corner plate 9 may be folded along the folding mark to match the second portion 92 of the corner plate 9, and then the connecting portion 93 of the first portion 91 of the corner plate 9 may be physically connected to the second side plate 12. The first portion 91 of the corner plate 9, the second portion 92 of the corner plate 9, and the second side plate 12 may be relatively physically fixed (for example, by bonding), to fold the main body 10.

In the second case, as shown in FIG. 16 and FIG. 17, the first portion 91 of the corner plate 9 may be folded to match the first side plate 11, the second portion 92 of the corner plate 9 may be folded along the folding mark to match the first portion 91 of the corner plate 9, and the connecting portion 93 of the second portion 92 of the corner plate 9 may be physically connected to the first side plate 11. The second portion 92 of the corner plate 9, the first portion 91 of the corner plate 9, and the first side plate 11 may be relatively physically fixed (for example, by bonding), to fold the main body 10.

In some embodiments, the protrusion portion 93 may be provided with an adhesive such as a double-sided tape, to connect with the first side plate 11 or the second side plate 12, which is simple, convenient, and cost-effective, thereby saving the cost and improving the efficiency for using the packaging apparatus.

In some embodiments, the groove of the second portion 92 of the corner plate 9 may be formed via a clipping. For example, the groove and the protrusion portion 93 may be formed by using a paper knife or scissors to cut the corner plate 9. The protrusion portion 93 may be bonded to the second side plate 12 by providing an adhesive such as a double-sided tape or Velcro on a backside of the protrusion portion 93.

After the main body 10 is folded, the first side plate 11, the first portion 91 of the corner plate 9, the second portion 92 of the corner plate 9, and the second side plate 12 may be fixedly connected by the protrusion portion 93, which further improves the efficiency for using the packaging apparatus.

In some embodiments, the corner plate 9 may be in a rectangular or square shape. In some embodiments, the corner plate 9 may be a circular sector. For example, the corner plate 9 may be a circular sector with a central angle of 90 degrees, and an arc line of the circular sector may correspond to a top corner of the base plate 10, i.e., an intersection of the first side edge and the second side edge.

In some embodiments, the corner plate 9 in a square shape that may be more regular, which makes it easier to fold the corner plate 9 and to put the packaging apparatus into the packaging box.

In some embodiments, the groove may be in a right angle shape, and the protrusion portion 93 may be in a right triangle shape, which may make the main body 10 have a more regular shape and be easy to fold.

In some embodiments, the main body 10 may be folded to be in a pre-folding state. In the actual application, a user may directly fold on the main body 10 in the pre-folding state, thereby improving the efficiency of using the packaging apparatus.

In the pre-folding or partially folding state of the main body 10 as shown in FIG. 15, the first side plate 11 may be attached to the base plate 1, and the second portion 92 of the corner plate 9 may be physically connected to the second side plate 12. Alternatively, the second side plate 12 may be attached to the base plate 1, and the first portion 91 may be physically connected with the first side plate 11. The connection between the second portion 92 of the corner plate 9 and the second side plate 12 and/or the connection between the first portion 91 of the corner plate 9 and the first side plate 11 may be achieved using an adhesive or a fixing member. More descriptions regarding the adhesive or the fixing member may be found elsewhere in the present disclosure.

During folding the main body 10 from the pre-folding state to the folded state, the two second side plates 12 may be folded, until substantially perpendicular to the base plate 1, and the two first side plates 11 may be substantially perpendicular to the base plate 1. Since the protrusion portion 93 and the second portion 92 of the corner plate 9 are connected with the second side plate 12 as shown in FIG. 16, the first portion 91 of the corner plate 9 and the second portion 92 of the corner plate 9 may be connected to form the folded main body 10, which further improves the efficiency for using the packaging apparatus.

In some embodiments, in the unfolding state, the corner plate 9 may be disposed beside the first side plate 11. In the folded state, the corner plate 9 may be attached to the second side plate 12. In some embodiments, in the unfolding state, the corner plate 9 may be disposed beside the second side plate 12. In the folded state, the corner panels 9 may be attached to the first side plate 11, as shown in FIG. 17. In some embodiments, the corner plate 9 may be connected with the first side plate 11 or the second side plate 12 using an adhesive.

Some embodiments of the present disclosure provide a quick-folding packaging apparatus. The packaging apparatus may include two main bodies and two elastic sheets. As described above, in some embodiments, each of the two main bodies of the packaging apparatus may include one base plate. The base plate 1 of one main body 10 may be connected with the base plate 1 of the other main body 10, and a space for accommodating the object may be formed between the elastic sheets. In some embodiments, the packaging apparatus may include a main body and the main body may include two base plates 1, and the two base plates 1 on the main body 10 may be respectively quickly folded to package the object. The main body 10 including the two base plates 1 may be integrally formed, instead of using two independent main bodies for packaging. A quick folding process of the main body 10 including two base plates will be described below in conjunction with FIGS. 19-22.

Figure 18:
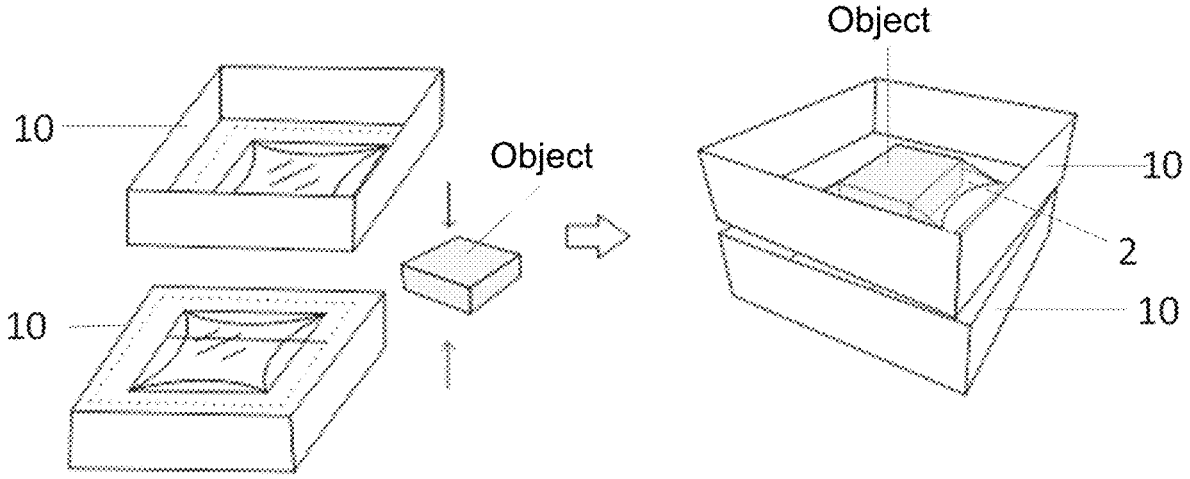
FIG. 18 is a schematic diagram illustrating an exemplary process for using packaging apparatuses as shown in FIG. 17 according to some embodiments of the present disclosure.

FIG. 18 is a schematic diagram illustrating an exemplary application process of a packaging apparatus including two folded main bodies as shown in FIG. according to some embodiments of the present disclosure. In the application of the packaging apparatus, the two first side plates 11 and two second side plates 11 in each main body 10 may be fixed relative to the base plate 1. The two first side plates 11 and the two second side plates 12 of each main body 10 may form a sidewall of the folded main body 10, and the base plate 1 may form the bottom of the folded main body 10. The sidewall and the bottom of the folded main body 10 may form a space. The object may be placed on the elastic sheet 2 connected with the base plate 1 of a first main body 10 of the two folded main bodies 10. Then, a second main body 10 of the two main bodies 10 may be stacked on the first main body 10. The elastic sheet 2 connected with the base plate 1 of the second main body 10 may contact and cover the object located on the first main body 10, such that the elastic sheets 2 of the two main bodies 10 wraps the object. Moreover, the base plates 1 of the two main bodies 10 may be attached to and aligned with each other, thereby packaging the object, as shown in FIG. 18. In some embodiments, the two main bodies 10 that wrap the object may also be put into a packaging box.

In this way, since the elastic sheet 2 in each main body 10 covers at least a part of the opening 19 on the base plate 1, and the elastic sheet 2 has a certain elasticity, the elastic sheet 2 in each main body 10 may be stretched after the object is located between the elastic sheets 2, such that there may be enough space for accommodating the object and the object may be wrapped in the accommodating space. Since the object is covered by the elastic sheets 2 and the elastic sheets 2 may be deformable to conform to the shape of the object, even if the object is in an irregular shape, the object may be stably wrapped. In addition, since the object is covered and/or wrapped by the two elastic sheets 2, it may effectively prevent water vapor from entering the accommodating space when the object needs to be shipped by sea or has a high moisture-proof requirement, thereby protecting the object.

It should be noted that the size of the opening 19 on each base plate 1 needs to allow a packaged object to pass through the opening 19. For example, the maximum diameter of the opening 19 may exceed or equal a maximum diameter of the object. In this way, when the base plates 1 of the two main bodies 10 are closely attached, the two elastic sheets 2 may completely seal and wrap the object, which ensures the stability and leakproof of the packaging apparatus.

Figure 19:
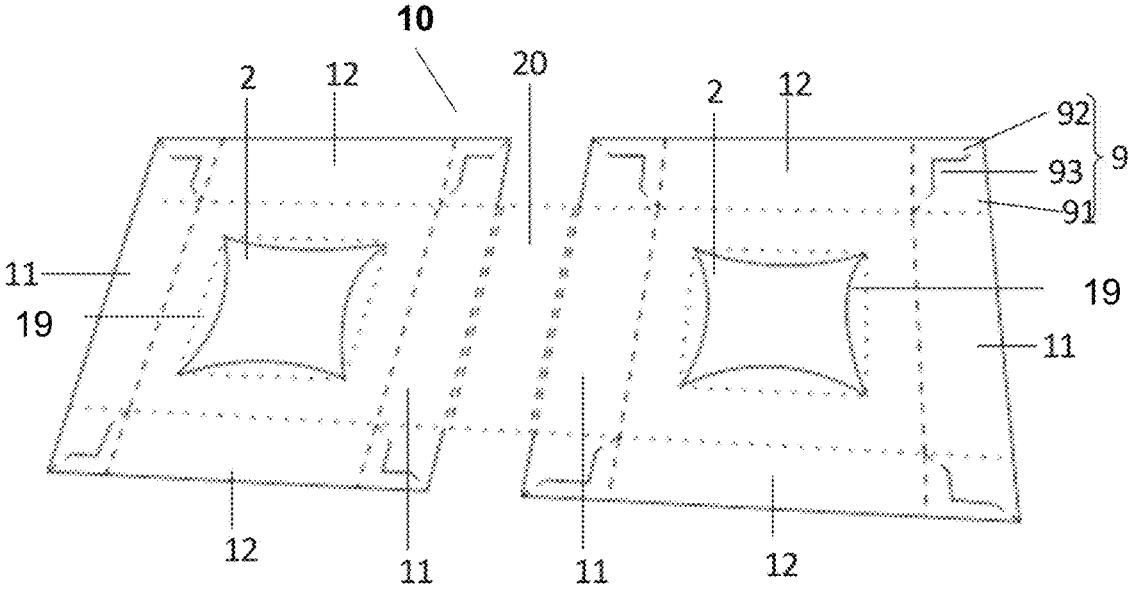
FIG. 19 is a schematic diagram illustrating an exemplary unfolded packaging apparatus according to some embodiments of the present disclosure.
Figure 20:
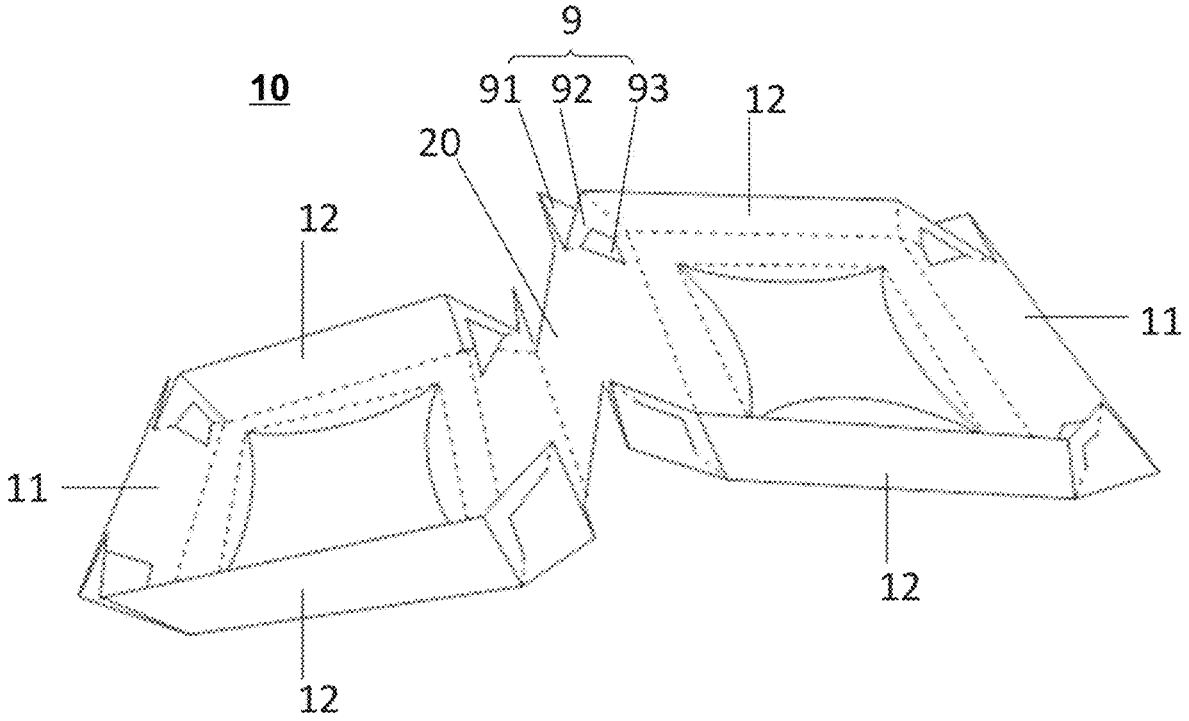
FIG. 20 is a schematic diagram illustrating the exemplary packaging apparatus with a first side plate and a second side plate folded according to some embodiments of the present disclosure.
Figure 21:
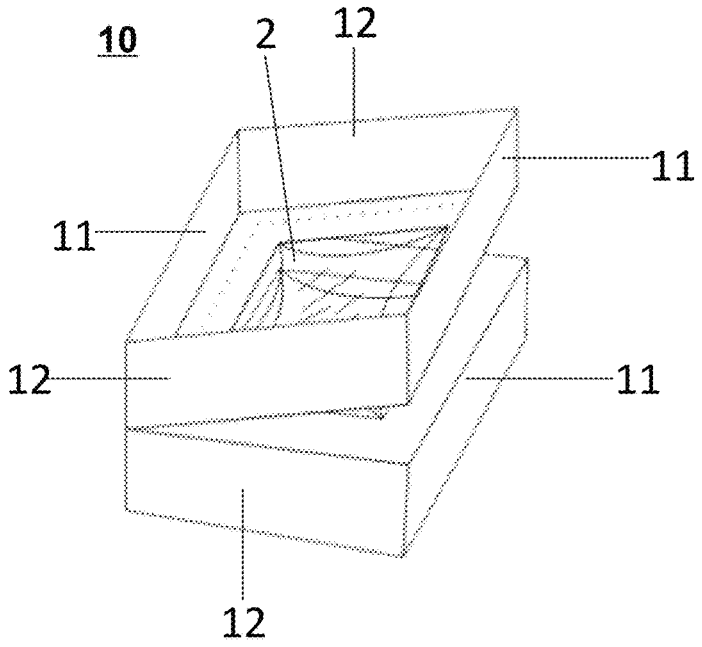
FIG. 21 is a schematic diagram illustrating an exemplary folded packaging apparatus according to some embodiments of the present disclosure.
Figure 22:
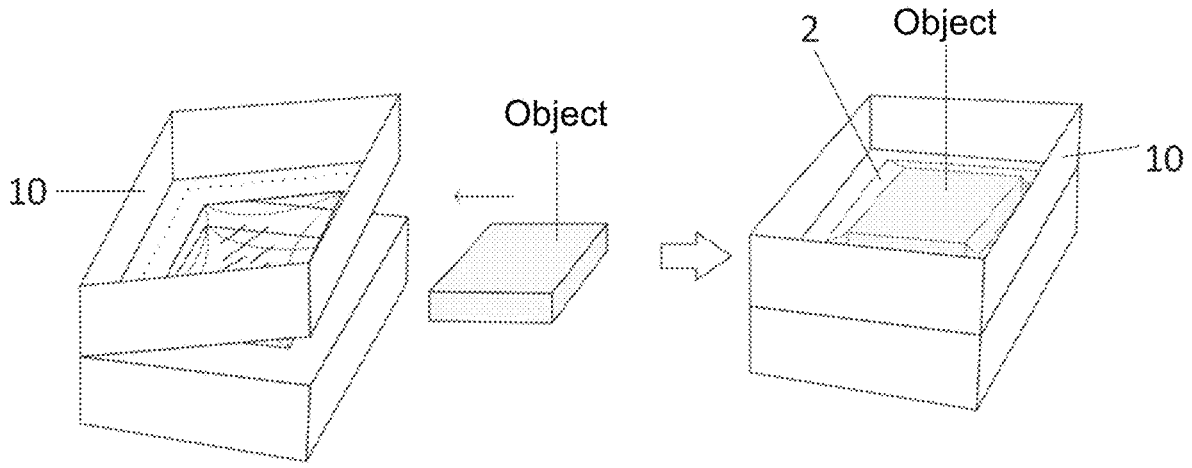
FIG. 22 is a schematic diagram illustrating an exemplary process for using a packaging apparatus as shown in FIG. 21 according to some embodiments of the present disclosure.

FIG. 19 is a schematic diagram illustrating an exemplary unfolded packaging apparatus according to some embodiments of the present disclosure. FIGS. 20-22 are schematic diagrams illustrating an exemplary process for the application of the packaging apparatus as shown in FIG. 19 according to some embodiments of the present disclosure.

The packaging apparatus as shown in FIG. 19 may include two main bodies each of which is the same as or similar to the main body as described in FIG. 14. Compared with the packaging apparatus as described in FIG. 14, the packaging apparatus in FIG. 19 may further include a coupling plate 20 disposed between the two main bodies. For example, the coupling plate 20 may be disposed between two base plates 1 of the two main bodies. Two opposite side edges of the coupling plate 20 may be connected to the first side plates 11 of the two base plates.

In a folded state, the coupling plate 20 may be a sidewall of the packaging apparatus, and cover the two first side plates 11 adjacent to the coupling plate 20. The "cover the two first side plates 11 adjacent to the coupling plate 20" may refer to that the surfaces of the two first side plates 11 connected with the coupling plate 20 are attached with the coupling plate 20. The total width of the two first side plates 11 may be substantially equal to a width of the coupling plate 20 in a direction parallel to the second side edge. The width of the first side plates 11 and the width of the middle plate 20 refer to a size along a direction perpendicular to the first side edge.

The coupling plate 20 may be disposed between the first side plates 11 of the two main bodies 10 that are adjacent to the coupling plate 20, which may be more convenient for using the two base plates 1 during the folding process. By connecting the two main bodies 10 via the coupling plate 20, the stability of the packaging apparatus may be improved. The coupling plate 20 may be equivalent to the first folding plate 3 in the FIGS. 2, 6A, and 6B. More descriptions regarding the folding process of the main body 10 shown in FIG. 19 may be referred to FIGS. 14-17. In addition, the main body 10 including the two base plates 1 shown in FIG. 19 may also be set in a pre-folding state. More descriptions regarding the pre-folding state of the main body 10 shown in FIG. 19 may be referred to elsewhere in the present disclosure. See, e.g., FIG. 15 and relevant descriptions thereof.

In some embodiments, in the main body 10 shown in FIG. 19, the coupling plate 20 and two first side plates 11 physically connected with the coupling plate 20 be removed. In some embodiments, the corner plates at two ends of the removed first side plates 11 may also be removed. The folding process of the main body 10 may be found elsewhere in the present disclosure, and will not repeat here.

In order to improve the stretching and fastening effect of the elastic sheet 2, in some embodiments, a plurality of stretching holes may be provided on the elastic sheet 2. When the elastic sheet 2 is stretched, the elastic sheet 2 may generate some concave and convex around under the pulling force relative to a surface of the elastic sheet 2, which increases the roughness of the elastic sheet 2 and improves the clamping and fixing effect toward the object.

In some embodiments, the elastic sheet 2 may have a certain elasticity. The elastic sheet 2 may include a thermoplastic polyurethane elastomer rubber, a nylon film, a polyethylene plastic film, which has high strength, high toughness, and/or wear resistance, thereby improving the fastening and fixing effect toward the object. In some embodiments, the thermoplastic polyurethane elastomer rubber may have high strength, wear resistance, and high toughness. When used to package the object, the thermoplastic polyurethane elastomer rubber may be stretched better, to provide a better fastening effect for the object, and prolong the service life of the packaging apparatus.

In some embodiments, the elastic sheet 2 may include one or more elastic sub-sheets. Each elastic sub-sheet may include a fixing part and a packaging part. The fixing part of each elastic sub-sheet may be connected to two side plates. The packaging parts of the several elastic sub-sheets may be in contact with a key part of the object, to fix the object. The key part of the object may include at least one of a top corner part, an edge part, and a center part of the object. In some embodiments, the fixing part of each elastic sub-sheet may be respectively physically connected to two adjacent side plates among the first side plate, the second side plate, the third side plate, and the fourth side plate. The packaging part of each elastic sub-sheet may correspond to a top corner part of the base plate 1.

In some embodiments, the count of the elastic sub-sheets of the elastic sheet 2 may be in a range from 1 to 4. The fixing part of each elastic sub-sheet may be disposed outside of the base plate. If the elastic sheet 2 includes one elastic sub-sheet, the elastic sub-sheet may be fixed on a middle region of the front side of the base plate 1, to fix a middle part of an object. If the elastic sheet 2 includes two elastic sub-sheets, the two elastic sub-sheets may be fixed on two opposite corners of the front side of the base plate 1, to fix opposite corners of the object. The two elastic sub-sheets may be fixed on two side edges of the front side of the base plate 1, to fix two side edges of the object. If there are three elastic sub-sheets, the three elastic sub-sheets may be fixed on any three top corners on the front side of the base plate 1, to fix the corresponding three corners of the object. If there are four elastic sub-sheets, the four elastic sub-sheets may be respectively fixed on the four top corners of the front side of the base plate 1, to fix four corners of the object.

According to some embodiments of the present disclosure, a packaging box including a box body and the above packaging apparatus is provided. The object packaged by the packaging apparatus as described elsewhere in the present disclosure may suspend in the packaging box. The packaging box may enable the object in an irregular shape to be packaged more easily, which solves a problem relating to difficulty in an assembly line for packaging the object, improve the aesthetics of the folded packaging apparatus, and have a moisture-proof effect since the object contacts with and be surrounded by the elastic sheet 2. Also, the packaging box may support multi-shape or types of objects, thereby achieving strong versatility.

Having thus described the basic concepts, it may be rather apparent to those skilled in the art after reading this detailed disclosure that the foregoing detailed disclosure is intended to be presented by way of example only and is not limiting. Various alterations, improvements, and modifications may occur and are intended to those skilled in the art, though not expressly stated herein. These alterations, improvements, and modifications are intended to be suggested by this disclosure and are within the spirit and scope of the exemplary embodiments of this disclosure.

Moreover, certain terminology has been used to describe embodiments of the present disclosure. For example, the terms "one embodiment," "an embodiment," and/or "some embodiments" mean that a particular feature, structure, or characteristic described in connection with the embodiment is included in at least one embodiment of the present disclosure. Therefore, it is emphasized and should be appreciated that two or more references to "an embodiment" or "one embodiment" or "an alternative embodiment" in various portions of the present disclosure are not necessarily all referring to the same embodiment. Furthermore, the particular features, structures, or characteristics may be combined as suitable in one or more embodiments of the present disclosure.

Similarly, it should be appreciated that in the foregoing description of embodiments of the present disclosure, various features are sometimes grouped together in a single embodiment, figure, or description thereof to streamline the disclosure aiding in the understanding of one or more of the various inventive embodiments. This method of disclosure, however, is not to be interpreted as reflecting an intention that the claimed object matter requires more features than are expressly recited in each claim. Rather, inventive embodiments lie in less than all features of a single foregoing disclosed embodiment.

In some embodiments, the numbers expressing quantities, properties, and so forth, used to describe and claim certain embodiments of the application are to be understood as being modified in some instances by the term "about," "approximate," or "substantially." For example, "about," "approximate" or "substantially" may indicate ±20% variation of the value it describes, unless otherwise stated. Accordingly, in some embodiments, the numerical parameters set forth in the written description and attached claims are approximations that may vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the application are approximations, the numerical values set forth in the specific examples are reported as precisely as practicable.

Each of the patents, patent applications, publications of patent applications, and other material, such as articles, books, specifications, publications, documents, things, and/or the like, referenced herein is hereby incorporated herein by this reference in its entirety for all purposes, excepting any prosecution file history associated with same, any of same that is inconsistent with or in conflict with the present document, or any of same that may have a limiting effect as to the broadest scope of the claims now or later associated with the present document. By way of example, should there be any inconsistency or conflict between the description, definition, and/or the use of a term associated with any of the incorporated material and that associated with the present document, the description, definition, and/or the use of the term in the present document shall prevail.

In closing, it is to be understood that the embodiments of the application disclosed herein are illustrative of the principles of the embodiments of the application. Other modifications that may be employed may be within the scope of the application. Thus, by way of example, but not of limitation, alternative configurations of the embodiments of the application may be utilized in accordance with the teachings herein. Accordingly, embodiments of the present application are not limited to that precisely as shown and described.

What is claimed is:

1. A packaging apparatus, comprising:

a main body including multiple base plates, each of the multiple base plates having two opposite first side edges, two opposite second side edges, and an opening; and multiple elastic sheets each of which corresponds to one of the multiple base plates, the multiple elastic sheets being physically connected with the main body, and each of the multiple elastic sheets covering at least a part of the opening, wherein the main body further includes a first side plate disposed beside at least one of the two opposite first side edges at least one second side plate disposed beside each of the two opposite second side edges, and one or more corner plates disposed between the first side plate and one or more of the at least one second side plate adjacent to the first side plate, and each of at least one of the one or more corner plates includes a first portion and a second portion, the first portion being disposed beside the first side plate, the second portion being disposed beside the least one second side plate, and a folding mark being disposed between the first portion and the second portion, each of at least one of the one or more corner plates includes a cutting line, both ends of the cutting line being disposed on the folding mark, when using the packaging apparatus to package a subject, the multiple base plates are attached and the subject is located between the multiple elastic sheets.

2. The packaging apparatus of claim 1, wherein the cutting line includes one or more straight line segments or an arc line.

3. The packaging apparatus of claim 1, wherein the at least one second side plate is physically connected with the second portion of one of the one or more corner plates; or the at least one second side plate is attached with one of the multiple base plates, and the first side plate is physically connected with the first portion of one of the one or more corner plates.

4. A packaging apparatus, comprising:

a first portion including a first base plate, multiple first side plates around the first base plate, and a first elastic sheet covering at least a part of a first opening on the first base plate; and a second portion including a second base plate, multiple second side plates around the second base plate, and a second elastic sheet covering at least a part of a second opening the second base plate, wherein one or more corner plates are disposed between the first side plate and the multiple second side plate adjacent to the first side plate, wherein each of at least one of the one or more corner plates includes a first portion and a second portion, the first portion of the corner plate being disposed beside the first side plate, the second portion of the corner plate being disposed beside the least one second side plate, and a folding mark being disposed between the first portion of the corner plate and the second portion of the corner plate, each of at least one of the one or more corner plates includes a cutting line, both ends of the cutting line being disposed on the folding mark, and when using the packaging apparatus to package a subject, the first base plate and the second base plate are attached with each other, and the subject is located between the first elastic sheet and the second elastic sheet.

5. The packaging apparatus of claim 4, wherein the cutting line includes one or more straight line segments or an arc line.

6. The packaging apparatus of claim 4, wherein the at least one second side plate is physically connected with the second portion of one of the one or more corner plates; or the at least one second side plate is attached with one of the multiple base plates, and the first side plate is physically connected with the first portion of one of the one or more corner plates.

7. The packaging apparatus of claim 4, wherein at least one of the multiple elastic sheets is disposed on a side of one of the multiple base plates where the subject is located.

* * * * *